US012022907B2

(12) United States Patent
Gaba

(10) Patent No.: US 12,022,907 B2
(45) Date of Patent: Jul. 2, 2024

(54) ARTICLE WITH RIBBON LOOPS FOR STRING LASTING

(71) Applicant: Under Armour, Inc., Baltimore, MD (US)

(72) Inventor: Monibert Narito Gaba, Sherwood, OR (US)

(73) Assignee: Under Armour, Inc., Baltimore, MD (US)

( * ) Notice: Subject to any disclaimer, the term of this patent is extended or adjusted under 35 U.S.C. 154(b) by 216 days.

(21) Appl. No.: 17/203,257

(22) Filed: Mar. 16, 2021

(65) Prior Publication Data

US 2021/0204633 A1 Jul. 8, 2021

Related U.S. Application Data

(62) Division of application No. 16/192,534, filed on Nov. 15, 2018, now Pat. No. 10,993,497.

(51) Int. Cl.

| | |
|---|---|
| ***A43C 1/04*** | (2006.01) |
| ***A43B 1/00*** | (2006.01) |
| ***A43B 9/02*** | (2006.01) |
| ***A43B 23/02*** | (2006.01) |

(52) U.S. Cl.

CPC ..... *A43B 1/0018* (2013.01); *A43B 1/0081* (2013.01); *A43B 9/02* (2013.01); *A43B 23/0205* (2013.01); *A43B 23/025* (2013.01); *A43C 1/04* (2013.01)

(58) Field of Classification Search

CPC ..... A43B 1/0081; A43B 9/02; A43C 1/00

USPC ..... 36/3 A

See application file for complete search history.

(56) References Cited

U.S. PATENT DOCUMENTS

| | | | |
|---|---|---|---|
| 313,301 | A | 3/1885 | Cross |
| 888,476 | A | 5/1908 | Davis |
| 1,124,184 | A | 1/1915 | Straub |
| 1,217,463 | A | 2/1917 | Krieger |
| 1,314,239 | A | 8/1919 | Bancroft |
| 1,469,222 | A | 10/1923 | Chapelle |
| 2,413,824 | A | 1/1947 | Glassman |
| 3,570,151 | A | 3/1971 | Eaton |
| 3,704,474 | A | 12/1972 | Winkler |
| 4,027,406 | A | 6/1977 | Salvatore |

(Continued)

FOREIGN PATENT DOCUMENTS

| | | |
|---|---|---|
| CN | 2712122 | 7/2005 |
| CN | 201431021 | 3/2010 |

(Continued)

OTHER PUBLICATIONS

Palho Sparta III Website, available at: http://www.paiho.com/index.php/en/menu-en-left-np-sparta (Nov. 3, 2015).

(Continued)

*Primary Examiner* — Timothy K Trieu

(74) *Attorney, Agent, or Firm* — Maginot, Moore & Beck, LLP

(57) ABSTRACT

An article of footwear includes a sole structure and an upper secured to the sole structure. The upper is configured to receive a foot of a wearer and has a peripheral region. Further, the upper includes a ribbon structure formed of a plurality of ribbon sections, and a plurality of ribbon loops extending from a peripheral region of the upper.

6 Claims, 24 Drawing Sheets

(56) References Cited

U.S. PATENT DOCUMENTS

| | | | | |
|---|---|---|---|---|
| 4,254,563 | A | 3/1981 | Bruno | |
| 4,393,605 | A | 7/1983 | Spreng | |
| 5,673,639 | A | 10/1997 | Miyachi et al. | |
| 6,060,145 | A | 5/2000 | Smith et al. | |
| 6,267,068 | B1 | 7/2001 | Fickers et al. | |
| 7,032,328 | B2 | 4/2006 | Wilson et al. | |
| 7,089,691 | B1 | 8/2006 | Silvera | |
| 7,115,315 | B2 | 10/2006 | Fowler | |
| 7,293,371 | B2 | 11/2007 | Aveni | |
| 8,122,616 | B2 | 2/2012 | Meschter et al. | |
| 8,595,878 | B2 | 12/2013 | Huffa et al. | |
| 8,656,606 | B2 | 2/2014 | Hooper | |
| 9,179,739 | B2 | 11/2015 | Bell et al. | |
| 9,420,844 | B2 | 8/2016 | Meir et al. | |
| 9,622,542 | B2 | 4/2017 | Greene | |
| 9,655,407 | B2 | 5/2017 | Reinhardt et al. | |
| 10,485,302 | B2 | 11/2019 | Christensen et al. | |
| 2002/0178610 | A1 | 12/2002 | Cheng | |
| 2003/0148076 | A1 | 8/2003 | Huang | |
| 2004/0118018 | A1 | 6/2004 | Dua | |
| 2005/0153614 | A1 | 7/2005 | Dohler | |
| 2005/0241181 | A1 | 11/2005 | Cheng | |
| 2005/0262734 | A1 | 12/2005 | Cheng | |
| 2005/0262735 | A1 | 12/2005 | Cheng | |
| 2006/0048413 | A1* | 3/2006 | Sokolowski ..... | A43B 23/0235 36/45 |
| 2007/0180730 | A1 | 8/2007 | Greene et al. | |
| 2007/0271822 | A1 | 11/2007 | Meschter | |
| 2007/0271823 | A1* | 11/2007 | Meschter ..... | A43D 8/16 36/47 |
| 2009/0071041 | A1 | 3/2009 | Hooper | |
| 2009/0133287 | A1 | 5/2009 | Meschter | |
| 2010/0107442 | A1 | 5/2010 | Hope et al. | |
| 2011/0041359 | A1 | 2/2011 | Dojan et al. | |
| 2011/0237995 | A1 | 9/2011 | Ota et al. | |
| 2011/0287212 | A1 | 11/2011 | Miloslavsky | |
| 2012/0023686 | A1 | 2/2012 | Huffa et al. | |
| 2012/0023778 | A1 | 2/2012 | Dojan et al. | |
| 2012/0198727 | A1 | 8/2012 | Long | |
| 2012/0297642 | A1 | 11/2012 | Schaefer et al. | |
| 2012/0324658 | A1 | 12/2012 | Dojan et al. | |
| 2013/0019500 | A1 | 1/2013 | Greene | |
| 2013/0081307 | A1 | 4/2013 | del Biondi et al. | |
| 2013/0139329 | A1 | 6/2013 | Ferniani et al. | |
| 2013/0247417 | A1 | 9/2013 | Nurse et al. | |
| 2013/0255103 | A1 | 10/2013 | Dua et al. | |
| 2013/0312284 | A1 | 11/2013 | Berend et al. | |
| 2014/0020193 | A1 | 1/2014 | Dojan et al. | |
| 2014/0059883 | A1 | 3/2014 | Adeagbo et al. | |
| 2014/0130270 | A1 | 5/2014 | Baudouin et al. | |
| 2014/0130372 | A1* | 5/2014 | Aveni ..... | D04B 1/22 36/83 |
| 2014/0157623 | A1 | 6/2014 | Dekovic | |
| 2014/0173934 | A1 | 6/2014 | Bell | |
| 2014/0237858 | A1 | 8/2014 | Adami et al. | |
| 2014/0238082 | A1 | 8/2014 | Meir | |
| 2014/0283411 | A1 | 9/2014 | Nabernik et al. | |
| 2014/0310986 | A1 | 10/2014 | Tamm et al. | |
| 2014/0338222 | A1 | 11/2014 | Song | |
| 2014/0373389 | A1 | 12/2014 | Bruce | |
| 2015/0143640 | A1 | 5/2015 | Dojan et al. | |
| 2015/0210034 | A1 | 7/2015 | Tarrier et al. | |
| 2015/0272272 | A1 | 10/2015 | Scofield | |
| 2015/0272274 | A1 | 10/2015 | Berns et al. | |
| 2016/0213095 | A1 | 7/2016 | Kohatsu et al. | |
| 2016/0286898 | A1 | 10/2016 | Manz et al. | |
| 2016/0316855 | A1 | 11/2016 | Berns et al. | |
| 2016/0316856 | A1 | 11/2016 | Berns et al. | |
| 2016/0345675 | A1 | 12/2016 | Bruce et al. | |
| 2016/0345677 | A1 | 12/2016 | Bruce et al. | |
| 2016/0345678 | A1 | 12/2016 | Mokos | |
| 2016/0353828 | A1 | 12/2016 | Chen | |
| 2017/0143076 | A1 | 5/2017 | Farris | |
| 2017/0156434 | A1 | 6/2017 | Tamm et al. | |
| 2017/0156439 | A1 | 6/2017 | Yoshida et al. | |
| 2017/0156444 | A1 | 6/2017 | Guest et al. | |
| 2017/0156445 | A1 | 6/2017 | Guest et al. | |
| 2017/0157846 | A1 | 6/2017 | Miller et al. | |
| 2017/0202296 | A1 | 7/2017 | Fuerst et al. | |
| 2017/0332722 | A1 | 11/2017 | Dealey et al. | |
| 2017/0340064 | A1 | 11/2017 | Salomon | |
| 2018/0116317 | A1 | 5/2018 | Inoue et al. | |
| 2018/0279721 | A1 | 10/2018 | Doenges | |

FOREIGN PATENT DOCUMENTS

| | | | |
|---|---|---|---|
| CN | 103989290 | | 8/2014 |
| FR | 2626201 | A1 | 7/1989 |
| GB | 1079731 | A | 8/1967 |
| JP | 06057613 | A | 3/1994 |
| JP | 08246323 | A | 9/1996 |
| JP | 2016195676 | A | 11/2016 |
| TW | 340310 | | 9/1998 |
| TW | 351073 | | 1/1999 |
| TW | 351670 | | 2/1999 |
| TW | 353601 | | 3/1999 |
| TW | M433121 | | 3/1999 |
| TW | 412939 | | 11/2000 |
| TW | 503275 | | 9/2002 |
| TW | 521584 | | 2/2003 |
| TW | M257116 | | 2/2005 |
| TW | M357218 | | 5/2009 |
| TW | M378896 | | 4/2010 |
| TW | M420202 | | 1/2012 |
| TW | M433118 | | 7/2012 |
| TW | M437635 | | 9/2012 |
| TW | M451012 | | 4/2013 |
| TW | M456105 | | 7/2013 |
| TW | M476494 | | 4/2014 |
| TW | M476496 | | 4/2014 |
| TW | M527445 | | 8/2016 |
| WO | 90/03744 | A1 | 4/1990 |
| WO | 2015038243 | A1 | 3/2015 |
| WO | 2015105564 | | 7/2015 |
| WO | 2018129601 | | 7/2018 |

OTHER PUBLICATIONS

International Search Report and Written Opinion dated Sep. 20, 2018 in PCT/US2018/039904.

International Search Report and Written Opinion dated May 1, 2019 for Application No. PCT/US2019/019481.

International Search Report and Written Opinion dated May 1, 2019 for Application No. PCT/US2019/019490.

International Search Report and Written Opinion dated May 7, 2019 for Application No. PCT/US2019/019492.

International Search Report and Written Opinion dated May 13, 2019 for Application No. PCT/US2019/019486.

Wikipedia, "Stich (textile arts)" May 6, 2016 (May 6, 2016), retrieved on Apr. 24, 2019 from https://en.wikipedia.org/w/index.php?title=Stitch_(textile_arts)&oldid=718918887.

International Search Report and Written Opinion dated Sep. 11, 2019 for Application No. PCT/US2019/038388.

International Search Report and Written Opinion dated Sep. 17, 2019 for Application No. PCT/US2019/038392.

International Search Report and Written Opinion dated Jan. 29, 2020 for PCT Application No. PCT/US2019/061073.

* cited by examiner

ARTICLE WITH RIBBON LOOPS FOR STRING LASTING

REFERENCE TO RELATED APPLICATION

This application is a division of U.S. application Ser. No. 16/192,534, filed on Nov. 15, 2018 and entitled "Article with Ribbon Loops for String Lasting", the disclosure of which application is entirely incorporated herein by reference.

BACKGROUND

Articles of footwear often include two primary elements, an upper and a sole structure, the upper being configured to contain or at least partially surround the foot, and the sole structure being configured to contact the ground. The upper is often formed from a plurality of material elements (for example, textiles, polymer sheets, foam layers, leather, and/or synthetic leather) that are stitched and/or adhesively bonded together to form an interior cavity for receiving a foot of a wearer.

During manufacturing, an article of footwear may be assembled on or around a last. Accordingly, the size and shape of the last determines the size and shape of the interior cavity defined by the upper when the article of footwear is assembled. These footwear components may be assembled together using various methods, including, for example, stitching, adhesives, welding, and other joining techniques. Articles of footwear may be assembled, at least in part, on a structure called a "last." A last is a form having the general shape of a human foot. A last is not typically shaped like any particular type of foot, but rather is formed having a shape with dimensions that are averages of many different foot types. This enables the footwear manufactured using the last to fit a variety of foot types.

When assembling a shoe using a last, one or more pieces of upper material may be assembled, or otherwise placed, on a last. These pieces of upper material are tightened around the last and secured to one another. Then one or more sole structure components may be secured to the upper while the upper is formed around the last.

In some cases, a strobel or sole board may be used to form the bottom of the shoe before the sole structure is attached. The peripheral edges of the upper may be affixed to the strobel during the lasting process to ensure that the upper takes the desired shape around the last. However, it may be desirable to produce a shoe without a strobel, in order to reduce weight and/or to eliminate any restrictions that the properties of the strobel may put on the ability to tune the performance characteristics of the footwear. In such cases, a technique is sometimes used to hold the peripheral edges securely around the last. For example, string lasting is used, which involves using loops at the peripheral edges of the upper, threading a lasting string through the loops and pulling the string tight the draw the edges of the upper toward one another around the periphery of the last bottom. With the edges of the upper drawn firmly in place and held by the lasting string, the sole structure may be attached to the upper.

Lasting loops can be difficult to construct with desired strength. If loops and lasting string are used with sufficient strength, these components can be undesirably thick, such that bumps are formed that are difficult to smooth out using the sole structure and/or insoles. It is desirable to provide a string lasting construction that addresses one or more of these issues discussed above.

SUMMARY

In one aspect, an article of footwear includes a sole structure and an upper secured to the sole structure. The upper is configured to receive a foot of a wearer and has a peripheral region. Further, the upper includes a ribbon structure formed of a plurality of ribbon sections, and a plurality of ribbon loops extending from a peripheral region of the upper.

In another aspect, an article of footwear includes an upper configured to receive a foot of a wearer, the upper having a peripheral region. The upper includes a ribbon structure formed of a plurality of ribbon sections, and a plurality of ribbon loops extending from a peripheral region of the upper. One or more of the plurality of ribbon loops are formed of end portions of the ribbon sections forming the ribbon structure.

In another aspect, the present disclosure is directed to a method of manufacturing an article of footwear. The method includes forming a piece of upper material including a ribbon structure formed by a plurality of ribbon sections, the piece of upper material having a shape configured to form an upper for an article of footwear. In addition, the method includes mounting the piece of upper material onto a last and drawing peripheral edges of the upper material toward one another at the bottom of the last by performing a string lasting process. The string lasting process includes threading a lasting string through a plurality of ribbon loops extending from a peripheral region of the piece of upper material, and pulling the lasting string the tighten the piece of upper material around the last.

In another aspect, the present disclosure is directed to a method of manufacturing an article of footwear. The method may include forming a piece of upper material including an embroidered peripheral portion and a plurality of embroidered loops extending from the peripheral portion, the piece of upper material having a shape configured to form an upper for the article of footwear. The method may also include mounting the piece of upper material onto a last, and drawing peripheral edges of the piece of upper material toward one another at the bottom of the last by performing a string lasting process. The string lasting process may include threading a lasting string through the plurality of embroidered loops; and pulling the lasting string to produce tension in the lasting string and tighten the piece of upper material around the last. In addition, the method may also include fixedly attaching the peripheral portion of the piece of upper material to a strobel.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, with emphasis instead being placed upon illustrating the principles of the embodiments. Moreover, in the figures, like reference numerals designate corresponding parts throughout the different views.

DETAILED DESCRIPTION

The embodiments are related to an article including one or more ribbons, or portions of ribbon (e.g., a ribbon section). As used herein, the term "article" refers broadly to articles of footwear, articles of apparel (e.g., clothing), as well as accessories and/or equipment. For the purposes of general reference, an article is any item designed to be worn by or on a user, or act as an accessory. In some embodiments, an article may be an article of footwear, such as a shoe, sandal, boot, etc. In other embodiments, an article may be an article of apparel, such as a garment, including shirts, pants, jackets, socks, undergarments, or any other conventional item. In still other embodiments, an article may be an accessory such as a hat, glove, or bag worn by the wearer.

Articles of footwear include, but are not limited to, hiking boots, soccer shoes, football shoes, sneakers, running shoes, cross-training shoes, rugby shoes, basketball shoes, baseball shoes as well as other kinds of shoes. Moreover, in some embodiments, components may be configured for various kinds of non-sports-related footwear, including, but not limited to, slippers, sandals, high-heeled footwear, loafers as well as any other kinds of footwear. Articles of apparel include, but are not limited to, socks, pants, shorts, shirts, sweaters, undergarments, hats, gloves, as well as other kinds of garments. Accessories include scarves, bags, purses, backpacks, as well as other accessories. Equipment may include various kinds of sporting equipment including, but not limited to, bats, balls, various sporting gloves (e.g., baseball mitts, football gloves, ski gloves, etc.), golf clubs, as well as other kinds of sporting equipment.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

Figure 1:
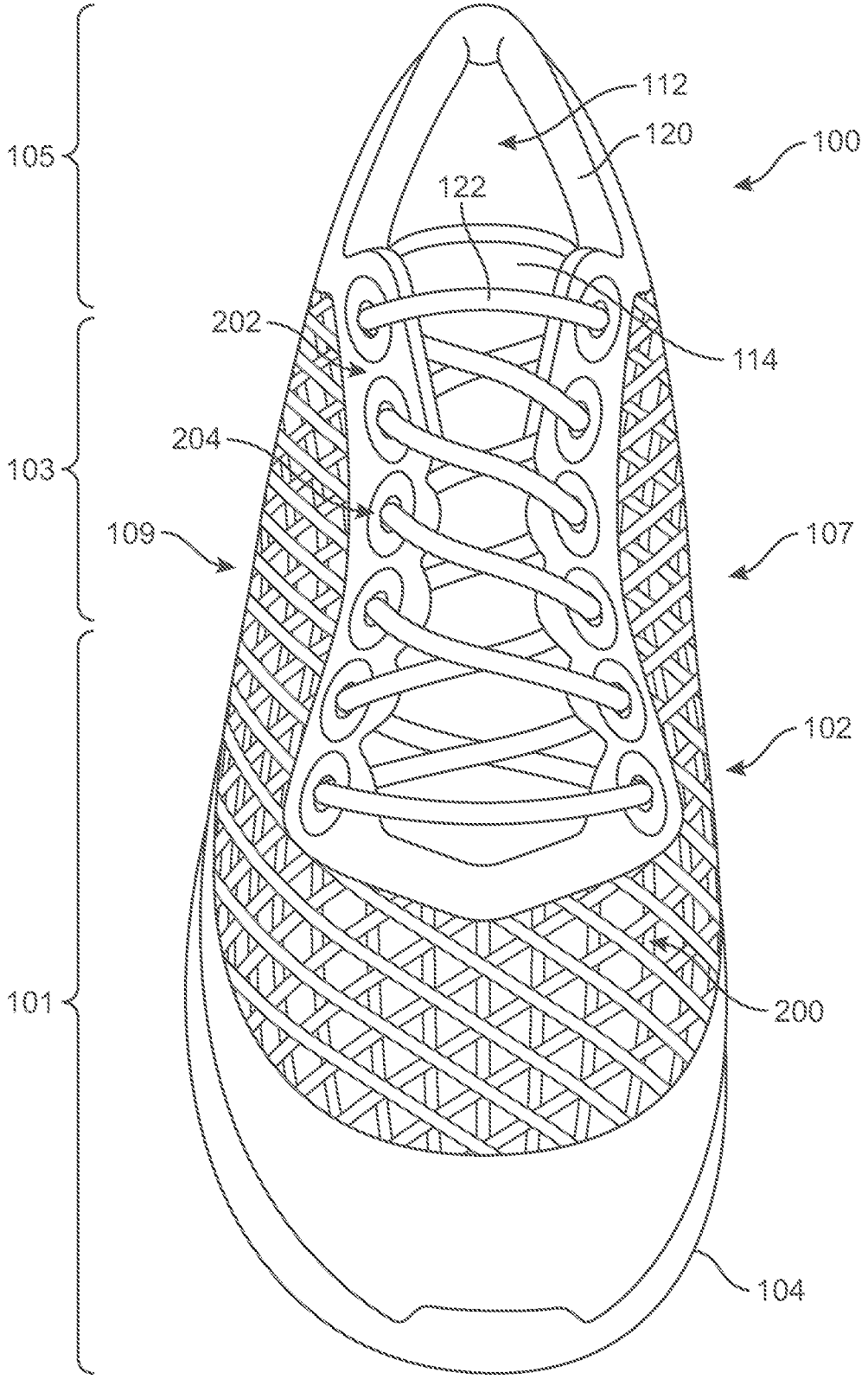
FIG. 1 is a schematic view of an embodiment of an article of footwear.

For purposes of general reference, as illustrated in FIG. 1, article of footwear 100 may be divided into three regions: forefoot region 101, midfoot region 103, and heel region 105. Forefoot region 101 may be generally associated with the toes and joints connecting the metatarsals with the phalanges. Midfoot region 103 may be generally associated with the arch of a foot, including the instep. Likewise, heel region 105 or "hindfoot" may be generally associated with the heel of a foot, including the calcaneus bone. For purposes of this disclosure, the following directional terms, when used in reference to an article of footwear, shall refer to the article of footwear when sitting in an upright position, with the sole facing the ground, that is, as it would be positioned when worn by a wearer standing on a substantially level surface.

The term "longitudinal," as used throughout this detailed description and in the claims, refers to a direction extending along the length of a component. For example, a longitudinal direction of an article of footwear extends from forefoot region 101 to heel region 105 of article of footwear 100. The term "forward" or "front" is used to refer to the general direction in which the toes of a foot point, and the term "rearward" or "back" is used to refer to the opposite direction, i.e., the direction in which the heel of the foot is facing.

The term "lateral direction," as used throughout this detailed description and in the claims, refers to a side-to-side direction extending along the width of a component. In other words, the lateral direction may extend between medial side 107 and lateral side 109 of article of footwear 100, with lateral side 109 of article of footwear 100 being the surface that faces away from the other foot, and medial side 107 being the surface that faces toward the other foot.

The term "vertical," as used throughout this detailed description and in the claims, refers to a direction generally perpendicular to both the lateral and longitudinal directions.

For example, in cases where an article of footwear is planted flat on a ground surface, the vertical direction may extend from the ground surface upward. It will be understood that each of these directional adjectives may be applied to individual components of an article of footwear. The term "upward" refers to the vertical direction heading away from a ground surface, while the term "downward" refers to the vertical direction heading toward the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

It will be understood that the forefoot region, the midfoot region, and the heel region are only intended for purposes of description and are not intended to demarcate precise regions of an article of footwear. For example, in some cases, one or more of the regions may overlap. Likewise, the medial side and the lateral side are intended to represent generally two sides, rather than precisely demarcating an article of footwear into two halves. In addition, the forefoot region, the midfoot region, and the heel region, as well as the medial side and the lateral side, may also be applied to individual components of an article of footwear, including a sole structure, an upper, a lacing system, and/or any other component associated with the article.

Article of footwear 100 may include upper 102 and sole or "sole structure" 104 (see also FIG. 2), which define an internal cavity between the upper and sole. The "interior" of an article of footwear refers to space in this internal cavity that is occupied by a wearer's foot when the article of footwear is worn. The "inner side" or "inside" of an element refers to the face of that element that is (or will be) oriented toward the internal cavity in a completed article of footwear. The "outer side," "outside," or "exterior" of an element refers to the face of that element that is (or will be) oriented away from the internal cavity in the completed article of footwear 100. In some cases, the inner side of an element may have other elements between that inner side and the interior in the completed article of footwear 100. Similarly, an outer side of an element may have other elements between that outer side and the space external to the completed article of footwear 100. Further, the terms "inward" and "inwardly" shall refer to the direction toward the interior of the article of footwear, and the terms "outward" and "outwardly" shall refer to the direction toward the exterior of article of footwear 100.

Upper 102 provides a covering for the wearer's foot that comfortably receives and securely positions the foot with respect to the sole structure. In general, as shown in FIG. 1, upper 102 includes opening 112 that provides entry for the foot into an interior cavity of upper 102 in heel region 105. Upper 102 may also include tongue 114 that provides cushioning and support across the instep of the foot. An upper may be of a variety of styles depending on factors such as desired use and required ankle mobility. For example, an athletic shoe with an upper having a "low-top" configuration extending below the ankle that is shaped to provide high mobility for an ankle. An upper could be configured as a "high-top" upper extending above the wearer's ankle for basketball or other activities, or as a "mid-top" configuration extending to about the wearer's ankle. Furthermore, an upper may also include non-athletic shoes, such as dress shoes, loafers, sandals, and work boots.

Upper 102 may also include other known features in the art including heel tabs, loops, etc. Furthermore, upper 102 may include a toe cage or box in the forefront region. Even further, upper 102 may include logos, trademarks, and instructions for care.

Upper 102 may include a fastener on a fastening region of the upper. For example, the fastening provision may be lacing system 122, or "lace," applied at a fastening region of upper 102. Other kinds of fastening provisions, include, but are not limited to, laces, cables, straps, buttons, zippers as well as any other provisions known in the art for fastening articles. For a lacing system, the fastening region may comprise one or more eyelets. The fastening region may comprise one or more tabs, loops, hooks, D-rings, hollows, or any other provisions known in the art for fastening regions.

Sole structure 104 is positioned between a foot of a wearer and the ground, and may incorporate various component elements. For example, sole structure 104 may include one or more of inner sole components or "insoles," a middle sole element or "midsole," and an outer sole element or "outsole." An insole may take the form of a sockliner adjacent the wearer's foot to provide a comfortable contact surface for the wearer's foot. It will be understood that an insole may be optional. Further, a midsole may directly serve as a cushion and support for the foot. In addition, an outsole may be configured to contact the ground surface.

Upper 102 and sole structure 104 may be coupled using any conventional or suitable manner, such as adhesion or bonding, via a woven connection, via one or more types of fasteners, etc. In some cases, a sole structure and an upper may be combined together in a single unitary construction.

Sole structure 104 may contact a ground surface and have various features to deal with the ground surface. Examples of ground surfaces include, but are not limited to, indoor ground surfaces such as wood and concrete floors, pavement, natural turf, synthetic turf, dirt, as well as other surfaces. In some cases, the lower portions of sole structure 104 may include provisions for traction, including, but not limited to, traction elements, studs, and/or cleats.

Sole structure 104 may be made of a variety of any suitable material or pluralities of materials for a variety of functions. For example, one or more components of sole structure 104, such as the midsole, may be formed from a polymer foam (e.g., a polyurethane or ethylvinylacetate foam) material that attenuates ground reaction forces (i.e., provides cushioning) during walking, running, and other ambulatory activities. In addition, the components of a sole may also include gels, fluid-filled chambers, plates, moderators, inserts, or other elements that further attenuate forces, enhance stability, or influence the motions of the foot. In addition, the other components may have specific surface properties, such as an outsole being made from a durable material, such as carbon or blown rubber, which is further textured to impart traction. Furthermore, the insole may be made from a waterproof material such as ethylvinylacetate to prevent moisture seeping into the sole.

For purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" shall refer to the joining of two components in a manner such that the two components are secured together, but may be readily detached from one another. Examples of removable attachment mechanisms may include hook and loop fasteners, friction fit connections, interference fit connections, threaded connectors, cam-locking connectors, and other such readily detachable connectors. Similarly, "removably disposed" shall refer to the assembly of two components in a non-permanent fashion.

The term "strand" includes a single fiber, filament, or monofilament, as well as an ordered assemblage of textile fibers having a high ratio of length to diameter and normally used as a unit (e.g., slivers, roving, single yarns, plies yarns, cords, braids, ropes, etc.). The term "thread" as used herein may refer to a strand used for stitching.

The embodiments discuss methods of embroidering or sewing one or more elements to a substrate. Embroidering an element to a substrate comprises stitching the element in place with a thread, yarn, or other strand of material.

The present application is directed to an upper including ribbon and portions or sections of ribbon. As used herein, the term "ribbon" refers to a long, narrow strip of material. In addition to the provisions described herein and shown in the figures, the embodiments may make use of any of the structures, components, and/or methods for articles with ribbon as disclosed in Luedecke et al., U.S. Patent Application Number 2019/0017205, currently U.S. application Ser. No. 15/648,638, filed Jul. 13, 2017 and titled "Article with Embroidered Tape Segments," the entirety of which is herein incorporated by reference.

Figure 2:
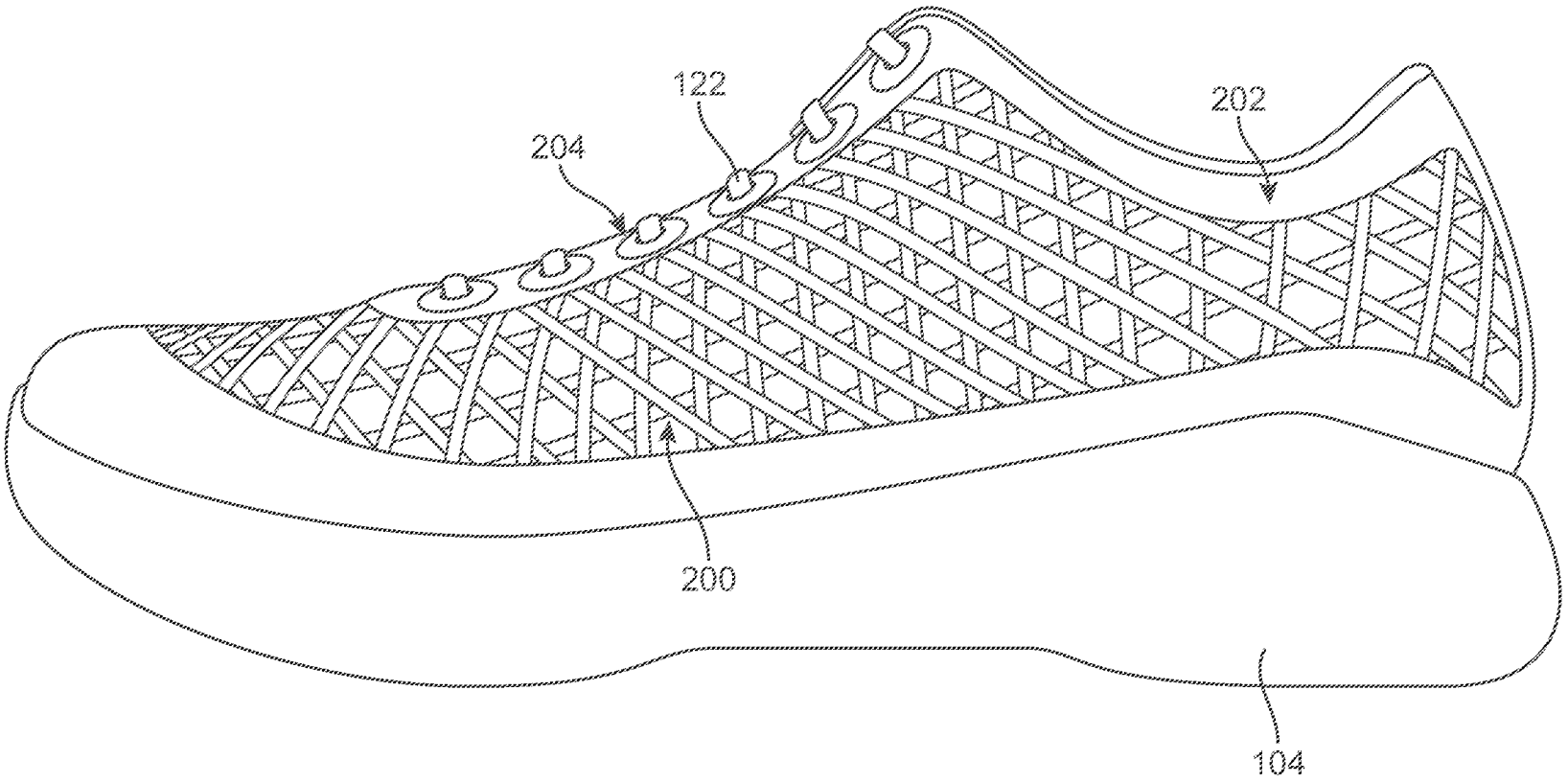
FIG. 2 is a schematic side view of an embodiment of an article of footwear.

FIG. 2 is a schematic side view of an embodiment of article of footwear 100. Referring to FIGS. 1-2, upper 102 may be comprised of ribbon structure 200, border element 202 and eyelet reinforcing elements 204. The term "ribbon structure," as used throughout this detailed description and in the claims, refers to any structure that is formed by attaching or otherwise arranging one or more ribbon pieces, sections, or portions into a structure on an upper. Ribbon structure 200 may extend through the entirety of upper 102. That is, ribbon structure 200 extends through forefoot region 101, midfoot region 103, and heel region 105 as well as through both medial side 107 and lateral side 109. In contrast, border element 202 may extend only on various edges or boundaries of upper 102. Border element 202 may extend along edges of upper 102 that are attached to sole structure 104 as well as along the periphery of opening 112.

While the exemplary embodiment includes eyelet reinforcing elements 204, other embodiments may not include reinforcing elements. In some cases, eyelets may be formed from openings in a border element.

Upper 102 may further include inner lining 120. Inner lining 120 could be any kind of lining known in the art for use in footwear. In some cases, inner lining 120 could be a knit or mesh lining. In still other cases, upper 102 may not include an inner lining and instead ribbon structure 200 could be a freestanding structure.

In some cases, ribbon sections could be separate segments or pieces (i.e., detached at their ends from one another). In other cases, ribbon sections could be part of a continuous ribbon with no natural boundary between adjacent sections.

Figure 14:
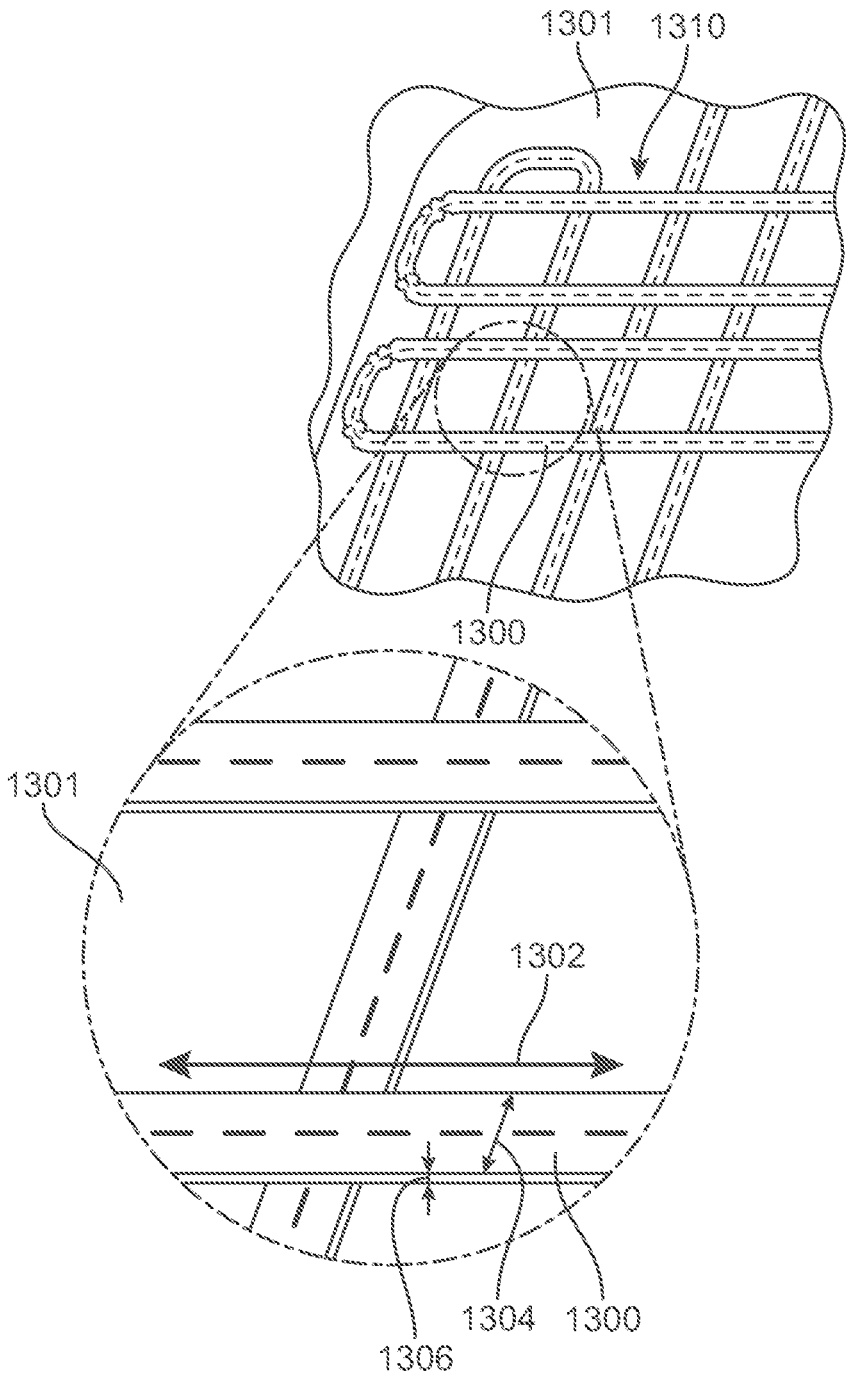
FIG. 14 is a schematic view of an embodiment of an article with an enlarged view of a region of a ribbon structure.

A ribbon may generally have a width that is greater than its thickness, giving the ribbon a two-dimensional appearance in contrast to threads or other strands that have a one-dimensional appearance. The dimensions of one or more ribbons could vary. For example, the thickness of a ribbon could vary in a range between approximately 0.2 millimeters and 1 millimeter. As another example, the width of a ribbon could vary in a range between approximately 2 millimeters and approximately 6 millimeters (e.g., 3 millimeters). If the width is substantially less than 2 millimeters the ribbon may be more difficult to stitch, weld, or otherwise attach to a backing layer or other element (e.g., another ribbon). If the width is substantially greater than 6 millimeters, the ribbon may tend to bend or fold with respect to a lengthwise direction, which may make attachment more difficult. The length of the ribbon may vary according to the particular pattern or design for an article and may generally be 10 millimeters or more. For purposes of clarity, FIG. 14 illustrates an exemplary embodiment of a ribbon 1300 with various dimensions. Ribbon 1300 has been stitched down to a backing layer 1301 as part of a ribbon structure 1310. Ribbon 1300 may have a lengthwise direction 1302. Ribbon 1300 may intersect one or more ribbon sections as it extends along lengthwise direction 1302. Ribbon 1300 also includes a width 1304 and a thickness 1306. In the embodiment of FIG. 14, width 1304 may be approximately 3 millimeters and thickness 1306 may be approximately 0.5 millimeters.

The material of one or more ribbons may vary. The ribbons may be formed of a generally flexible textile or fabric that resists elongation. The material could also be any material including a thermoplastic. Examples of thermoplastics include, but are not limited to: thermoplastic polyurethane (TPU), acrylic, nylon, polylactic acid (PLA), polyethylene, or acrylonitrile butadiene styrene (ABS) or ethylene vinyl acetate (EVA). Ribbons may be made from a foam, a film, and/or a composite with multiple layers—including polymer layers and fabric layers, for example.

A ribbon may be made of a material that undergoes little to no stretch under tension. This may help ensure the ribbon provides strength and support to parts of a foot along a tensioned direction. In some cases, the ribbon could stretch less than 40% of its pre-stretched length before inelastically deforming or before individual fibers begin to break. In some cases, the ribbon could stretch less than 20% of its pre-stretched length before inelastically deforming or before individual fibers begin to break. In one case, the ribbon could stretch less than 10% of its pre-stretched length before inelastically deforming or before individual fibers begin to break. That is, in one case, the ribbon could undergo elastic deformation of up to 10% of its pre-stretched length and return to its pre-stretched length without permanent change to its structure. To accommodate the stretch of a ribbon, the thread used to embroider or otherwise stitch the ribbon in place may be selected to have a degree of stretch that matches the degree of stretch of the ribbon, or which is greater than the degree of stretch of the ribbon.

Ribbons can have a knit, braided or woven construction. Ribbons could be made of a woven material that resists stretching. Moreover, the woven material may comprise a 0 and 90 degree weave arranged as a single layer.

Ribbons could be made of materials that expand under heat and/or pressure. Exemplary expanding materials include foam materials, expanding polymers, expanding films, and/or other expandable materials.

A border element 202 may extend around the edges or periphery of upper 102. In some cases, border element 202 may be an embroidered structure comprised of thread that has been stitched through ribbon structure 200 (as well as possibly other layers including a backing layer).

Border element 202 may comprise a continuous element that extends around the entire periphery of border element 202. Alternatively, border element 202 may be discontinuous and may have gaps along the periphery.

A border element may comprise threads stitched to another layer (e.g., a ribbon layer and/or a substrate/backing layer). A border element may comprise a standalone structure of threads that have been stitched together to form an interlocking matrix. The embroidered regions and/or structures of the present disclosure may utilize any of the structures, patterns, or features disclosed in Berns et al., U.S. Publication Number 2015/0272272, published on Oct. 1, 2015, and titled "Footwear Including Textile Element," the entirety of which is herein incorporated by reference and referred to as the "Embroidered Structures Application."

As discussed in the Embroidered Structures Application, some embodiments may incorporate self-supporting embroidered structures with threads or yarns arranged in a matrix that lacks a backing or support layer. Such embroidered structures could be formed by first stitching threads to a backing layer and later removing the backing layer. The embodiments can use any of the methods for forming embroidered structures as disclosed in the Embroidered Structures Application.

Threads used for embroidery or other forms of stitching may be comprised from a variety of materials. For example, thread may be made of polymer materials including nylon, polyethylene, TPU, PVA, or EVA as well as Dyneema fiber made from Ultra-High Molecular Weight Polyethylene. Thread may also include a blend of polymer materials and may include nitrile rubber. Thread also may be made from more conventional materials including cotton, silk, or other natural fibers disclosed herein. Other materials that may be used include, but are not limited to, nylon, polyester, polyacrylic, polypropylene, polyethylene, metal, silk, cellulosic fibers, elastomers, etc. Thread also may be made from any known synthetic equivalent. In some cases, exposing the thread to heat or pressure may cause the thread to melt or fuse. In other cases, exposing the thread to heat or pressure may cause the thread to dissolve. In still other cases, the thread may dissolve when exposed to a solvent, such as acid or water.

Threads may be comprised of a material that stretches lengthwise under tension. For example, in some embodiments, a thread could be an elastic thread. As an example, an elastic thread comprised of 60-70% polyester and 30-40% polyurethane could be used.

A first kind of thread may be used to embroider or otherwise stitch ribbons in place on a backing layer or other substrate. In addition, one or more border elements may be formed by further stitching over the ribbons and/or substrate layers using a second kind of thread. In some cases, the first and second kinds of thread could be similar kinds of threads. In other cases, however, the first and second kinds of thread could be different kinds of threads. For example, in some cases, the first kind of thread used to embroider down ribbons may have a narrower diameter than the second kind of thread used to form one or more border elements. Additionally, in some cases, the first and second kinds of thread could have different colors with the first kind of thread having a color that matches the color of ribbons and the second kind of thread having a color that is different (but perhaps complimentary to) than the color of the ribbons.

A backing layer, or backer layer, may be used during the embroidery process. A backing layer, in general, provides a layer to which one or more elements may be stitched. In some embodiments, a backing layer may remain after manufacturing to provide, for example, an inner lining for an article. Alternatively, the backing layer may be melted into the article. A backing layer could also be separated from other elements of an article after embroidering one or more ribbon sections into place. For example, the backing layer could be dissolved. Some embodiments can include an optional backing layer that may be distinct from an inner lining of an upper.

The materials of backing layers may vary. Backing layers or sheets may be used as an anti-abrasion layer, and may be made of a material soft to the skin, such as silk or cotton, as well as synthetic-like equivalents such as nylon, or foam materials. Backing layers may be used to prevent an article from stretching during embroidery, and may be used from a harder more rigid substance, such as a sheet made from TPU, PVA, or EVA. Backing layers also may be made from a fusible material such as EV, or a dissolvable material such as TPU, PVA, or EVA. Furthermore, backing layers may combine various materials for different purposes for different sections. For example, a rigid dissolvable backing material may be used in combination with a soft permanent backing layer. The backing layer may include a mesh. More specifically, the mesh may be elastic. It may be appreciated that any of the materials described here for backing layers could be used for ribbons.

Figure 3:
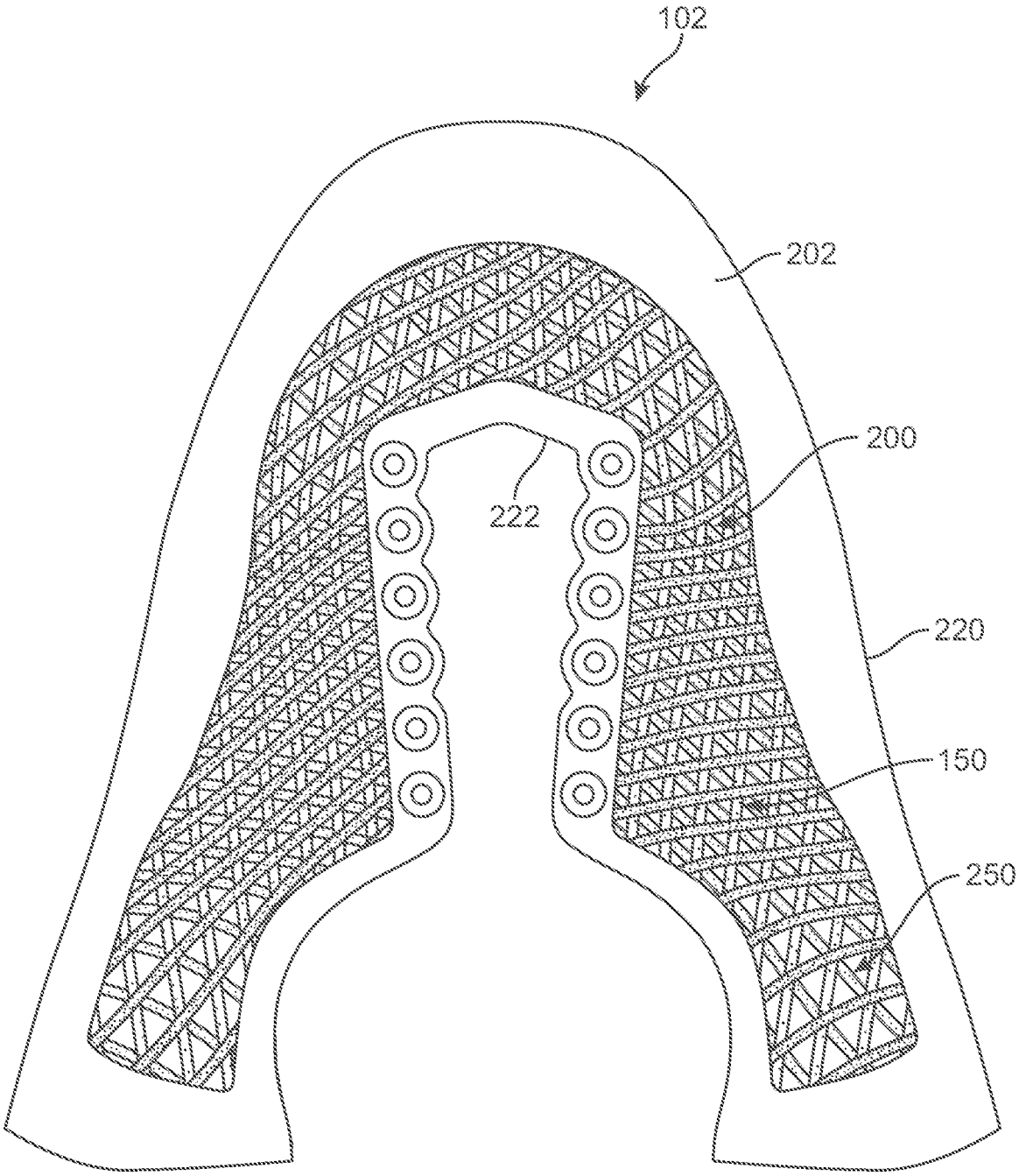
FIG. 3 is a top-down schematic view of an embodiment of an upper with a ribbon structure.

FIG. 3 is a schematic top-down view of upper 102 in a flattened configuration (i.e., in a configuration immediately following manufacturing of the upper but before the upper has been shaped and joined with sole structure 104).

Referring first to FIG. 3, upper 102 has outer peripheral edge 220 and inner peripheral edge 222. Inner peripheral edge 222 may extend around a lacing region of upper 102 as well as around other parts of a throat opening of upper 102. Outer peripheral edge 220 may be disposed adjacent a sole structure (e.g., sole structure 104 in FIGS. 1-2) when upper 102 is assembled with the sole structure. Upper 102 also includes an outer side (visible in FIG. 3) and an inner side (not shown). The inner side is the side of upper 102 that faces an interior foot receiving cavity of upper 102 while the outer side faces away from the interior foot receiving cavity.

With respect to these edges and sides, ribbon structure 200 extends substantially continuously throughout interior region 150 bounded by outer peripheral edge 220 and inner peripheral edge 222. In some cases, one or more continuous ribbons of ribbon structure 200 wind back and forth between inner peripheral edge 222 and outer peripheral edge 220. In the exemplary embodiment of FIG. 3, the entirety of ribbon structure 200 is comprised of a single continuous ribbon.

Also, in some cases, ribbon structure 200 extends along outer peripheral edge 220 and inner peripheral edge 222. Specifically, border element 202 extends along outer peripheral edge 220 and inner peripheral edge 222 but does not extend throughout the entirety of interior region 150.

Figure 4:
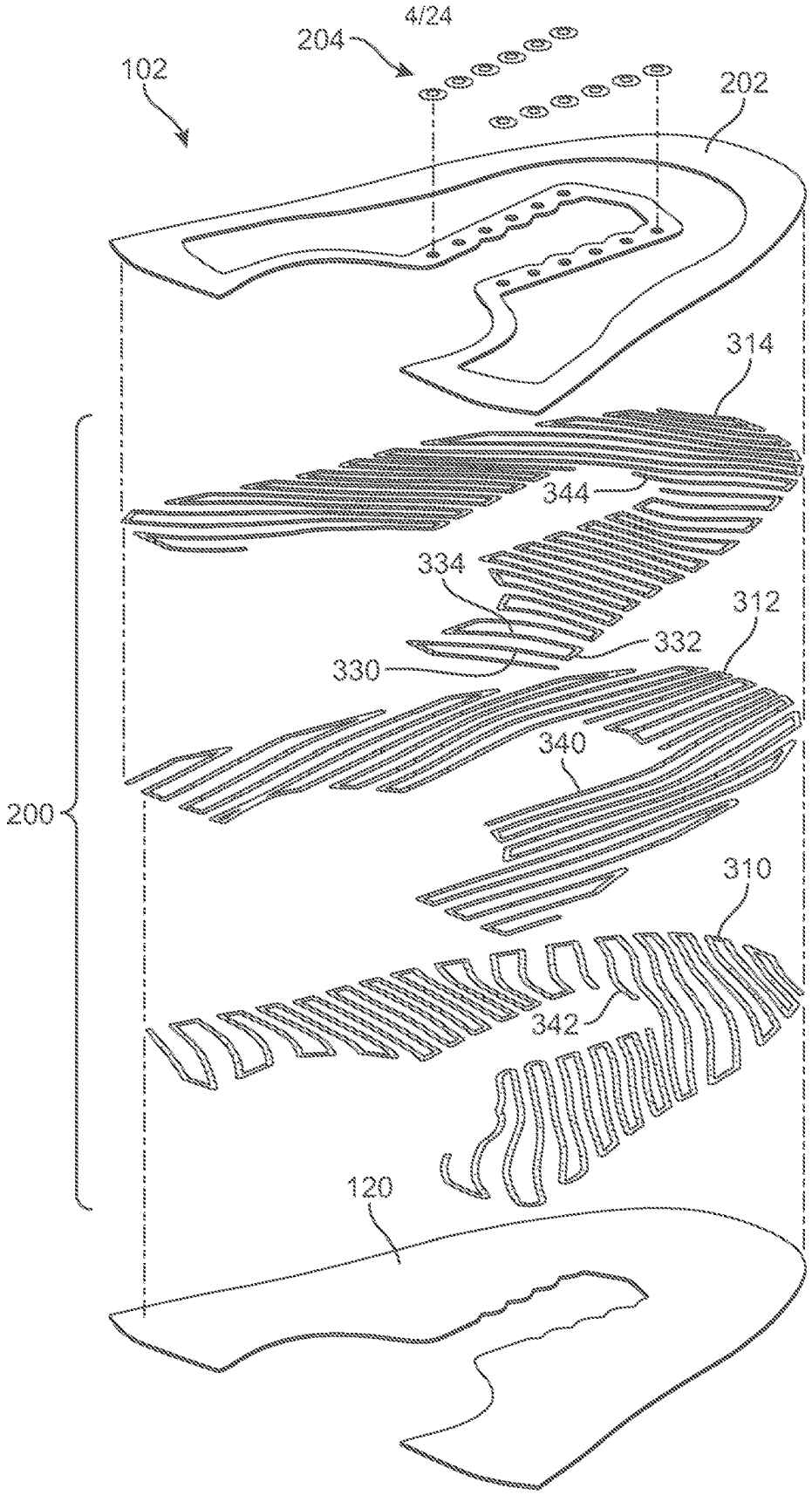
FIG. 4 is a schematic exploded view of the upper of FIG. 3.

FIG. 4 is an exploded isometric view of various layers of upper 102. Referring to FIG. 4, upper 102 includes border element 202, reinforcing eyelet reinforcing elements 204, ribbon structure 200, and inner lining 120. An optional backing or substrate layer may be disposed between ribbon structure 200 and inner lining 120 in some embodiments.

A ribbon structure could be comprised of a single layer. As used herein, a layer of ribbon refers to an arrangement of one or more ribbons along an approximately two-dimensional surface. A ribbon structure could be comprised of two or more ribbon layers. In the exemplary embodiment of FIG. 4, ribbon structure 200 is comprised of three layers including first (or inner) ribbon layer 310, second (or intermediate) ribbon layer 312, and third (or outer) ribbon layer 314.

In general, ribbons could be arranged in a variety of different patterns including, but not limited to, lattice patterns, grid patterns, web patterns, various mesh patterns as well as any other kinds of patterns. The type of pattern, including characteristics such as the spacing between adjacent ribbon sections, the sizes of ribbon sections (length, width, and thicknesses), and the relative arrangements of ribbon sections (stacked, woven, etc.), can be varied to achieve particular characteristics for the resulting structure including particular strength, flexibility, durability, weight, etc. It may be appreciated that using ribbons rather than cords can provide more positive engagement and more surface area to connect adjacent layers of ribbon. Furthermore, ribbons can be constructed with substantially small thicknesses so that the overall thickness of a ribbon structure can be kept substantially small, even when the ribbon structure is comprised of multiple ribbon layers.

Patterns may be formed by laying down ribbon sections in substantially straight and/or substantially curved paths within one or more layers. As used herein, a substantially straight ribbon path has a substantially higher radius of curvature than a substantially curved ribbon path.

Ribbon patterns within each layer may be created by laying down continuous ribbons in paths that have sections that are substantially straight and sections that are substantially curved. Patterns may include one or more "turns", or switchbacks, that result in a substantial change in the ribbon direction, thereby allowing the ribbons to wind (or weave) back and forth between the peripheral edges of the ribbon structure.

As an example, third ribbon layer 314 is comprised of three continuous ribbons that wind back and forth in a pattern bounded by the peripheral edges of upper 102. These continuous ribbons include both substantially straight ribbon sections (i.e., ribbon section 330) and substantially curved ribbon sections (i.e., ribbon section 332). Moreover, the curved ribbon sections are sections where the ribbon "turns" back and reverses directions (i.e., the curved ribbon sections form switchbacks). So, for example, one can follow ribbon section 330 along a first approximately lateral direction toward ribbon section 332. At ribbon section 332, the ribbon turns around and one can follow ribbon section 334 in a second approximately lateral direction away from ribbon section 332. Likewise, both of second ribbon layer 312 and first ribbon layer 310 are comprised of one or more continuous ribbons arranged in winding paths including both substantially straight sections and substantially curved sections.

Different ribbon layers may be associated with different orientations. That is, each layer may be comprised of straight ribbon sections that extend approximately along a single direction (or axis). For example, second ribbon layer 312 is comprised of straight ribbon sections 340 that are approximately oriented along a longitudinal direction of upper 102. Also, first ribbon layer 310 is comprised of straight ribbon sections 342 that extend along various non-longitudinal directions. Likewise, third ribbon layer 314 also is comprised of straight ribbon sections 344 that extend along various non-longitudinal directions. It may be appreciated that the orientations of ribbon sections within a layer may vary. However, in some cases, the orientations of ribbon sections in different layers could vary in a predetermined manner so that the relative orientations of the different layers are preserved throughout different regions of an upper.

The orientations of the ribbon sections in each of first ribbon layer 310, second ribbon layer 312, and third ribbon layer 314 may be selected so that when these layers are assembled they form a triaxial pattern, as clearly seen in FIGS. 1-3. This triaxial pattern is created since locally the ribbon sections of each of the three ribbon layers are oriented in three approximately distinct directions. The resulting gaps or openings formed between adjacent strands have a distinct triangular geometry (e.g., triangular gap 250 in FIG. 3).

The geometry of a ribbon structure may vary with different patterns, including variations in the number of layers, orientations of strands and relative spacing between ribbon sections being selected according to intended uses of an article. A ribbon structure comprising ribbon sections that are attached at various intersection points may provide improved flexibility, comfort, and reduce pressure points when compared to conventional upper materials. As a specific example, a triaxial ribbon pattern may be useful for distributing stresses along three distinct directions, thereby reducing the stress in any single direction.

As seen in FIG. 4, the various turns or curved ribbon sections form open-loops or partial-loops in ribbon sections along the peripheral edges of each ribbon layer and of upper 102. Moreover, when border element 202 is added to ribbon structure 200, these partial-loops may be at least partially covered and hidden from view.

Figure 5:
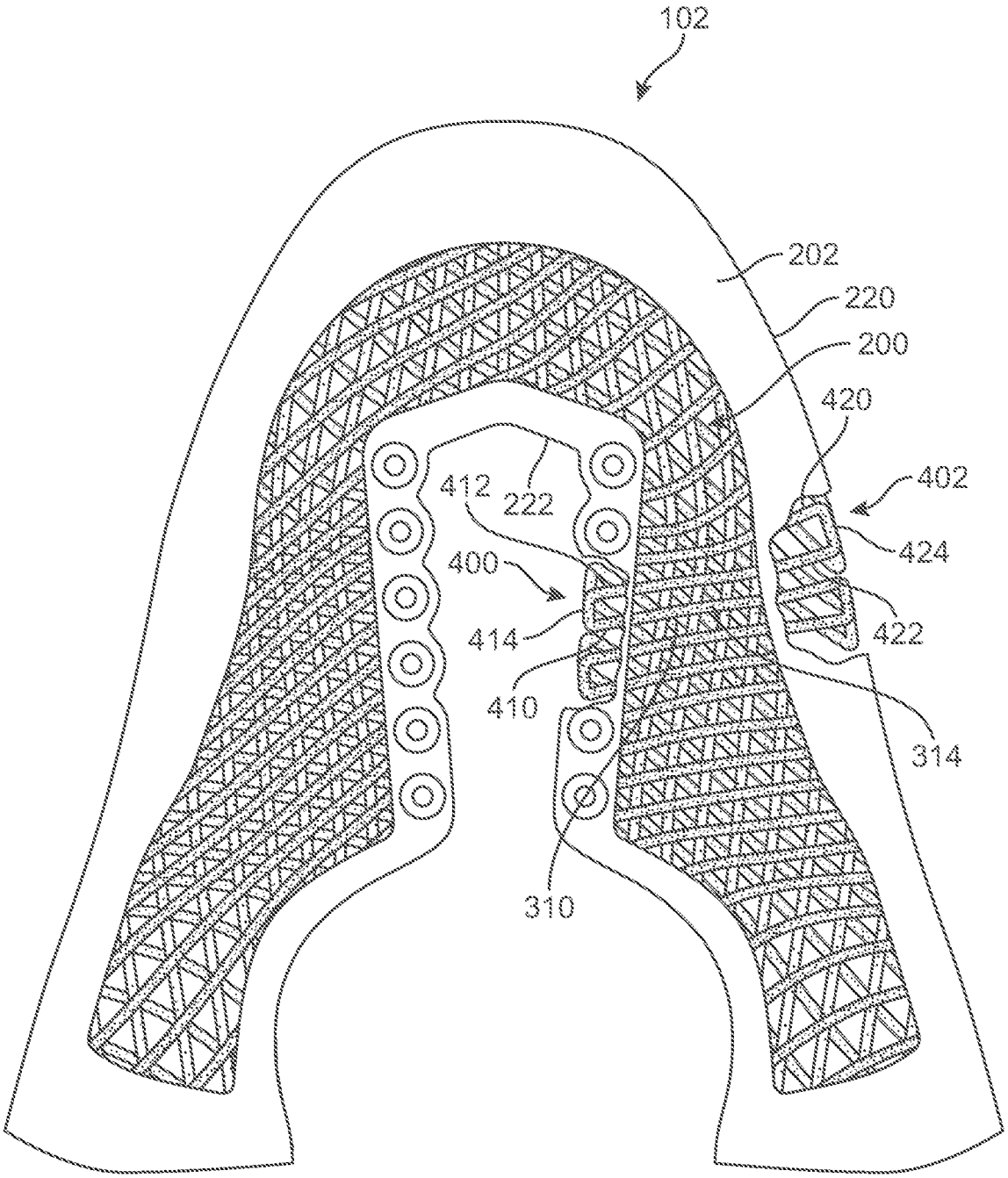
FIG. 5 is a schematic top-down view of an upper in which a portion of a border element is removed, according to an embodiment.

FIG. 5 is a schematic view of upper 102 with two cut-away sections: first cutaway section 400 and second cutaway section 402. Referring to FIG. 5, first cutaway section 400 is a section of upper 102 where a portion of border element 202 has been removed so that the underlying portions of ribbon structure 200 are visible along inner peripheral edge 222. Likewise, second cutaway section 402 is a section of upper 102 where a portion of border element 202 has been removed so that the underlying portions of ribbon structure 200 are visible along outer peripheral edge 220. For purposes of illustration only, small peripheral portions of the outer and inner peripheral edges of ribbon structure 200 are shown, but it may be understood that the entirety of the periphery of ribbon structure 200 is similar in configuration to these peripheral portions.

Within first cutaway section 400, a first partial-loop is shown comprising several sections of third ribbon layer 314: First straight ribbon section 410, second straight ribbon section 412, and curved ribbon section 414. Similar partial-loops of first ribbon layer 310 are also visible within first cutaway section 400.

The partial-loops of ribbon structure 200 extending along inner peripheral edge 222 may correspond with the locations of eyelets in upper 102. However, in other cases, the partial-loops may not correspond with the locations of eyelets in an upper.

Within second cutaway section 402, another partial-loop is shown comprising several sections of third ribbon layer 314: Third straight ribbon section 420, fourth straight ribbon section 422, and curved ribbon section 424. Similar partial-loops of first ribbon layer 310 are also visible within second cutaway section 402.

Thus, as seen in FIG. 5, border element 202 acts to cover the partial-loops located along the periphery of upper 102. With this arrangement, the visible portions of ribbon structure 200 have a near uniform and continuous triaxial pattern. Moreover, border element 202 may further act to smooth the surface along the periphery of upper 102, as described in further detail below.

A ribbon structure may be formed by attaching one or more ribbon layers to a backing layer. The ribbon layers may each be embroidered to the backing layer. Specifically, a first ribbon layer may be embroidered onto a backing layer. Then, a second ribbon layer may be embroidered onto the first ribbon layer and the backing layer. Then, a third ribbon layer may be embroidered onto the second ribbon layer, the first ribbon layer, and the backing layer.

Ribbons can be attached to substrate materials using any of the principles, methods, systems, and teachings disclosed in any of the following applications: Berns et al., U.S. Patent Application Publication Number 2016/0316856, published Nov. 3, 2016 and titled "Footwear Upper Including Strand Layers"; Berns et al., U.S. Patent Application Publication Number 2016/0316855, published Nov. 3, 2016 and titled "Footwear Upper Including Variable Stitch Density"; and Berns et al., U.S. Patent Application Publication Number 2015/0272274, published Oct. 1, 2015 and titled "Footwear Including Textile Element," the entirety of each application being herein incorporated by reference. Embodiments can use any known systems and methods for feeding ribbon to an embroidery or sewing machine including any of the systems and/or methods described in Miyachi et al., U.S. Pat. No. 5,673,639, issued Oct. 7, 1997 and titled "Method of feeding a piece of tape to a belt loop sewing machine and tape feeder for effecting same," the entirety of which is herein incorporated by reference.

The technique of stitching the ribbon sections to a substrate may vary. The stitch technique used may include chain stitch, double chain stitch, the buttonhole or blanket stitch, the running stitch, the satin stitch, the cross stitch, or any other stitch technique known in the art. A combination of known stitch techniques may also be used. These techniques may be used individually or in combination to stitch either individual ribbon sections or groups of ribbon sections in place. Moreover, the stitch length can also be varied.

The stitches may form a pattern. When the stitching is performed by a machine, the machine may use a computer-generated program to control the stitching, including the locations of the stitching relative to an underlying substrate, as well as how and which ribbon sections to feed, how to stitch the ribbon sections, and the technique of stitching used.

In some cases, only a single type of ribbon is stitched using a machine. In other cases, multiple types of ribbon may be stitched using the same ribbon-feeding assembly. In still other cases, an embroidery device may have multiple feeding assemblies to embroider multiple ribbon sections at the same time.

The method of stitching used to attach one or more ribbon sections may vary. The thread could be stitched around a ribbon section, thereby securing the ribbon in place on a substrate layer. That is, the thread could be stitched to the backing layer on one side of the ribbon section, passed over the opposing side of the ribbon section and then stitched to the backing layer, such that the stitch never passes through the ribbon section. Alternatively, thread could be stitched directly through a ribbon section. A ribbon section could have preconfigured holes for receiving stitches. Alternatively, a needle may pierce a ribbon section to place a stitch through the ribbon section.

FIGS. 6-9 illustrate schematic views of a process for laying down and embroidering sections of ribbon. FIGS. 6-9 depict an embodiment comprising a portion of backing layer 500, as well as some ribbon sections of first ribbon layer 502. In addition, FIGS. 6-9 illustrate steps in a process of laying down and embroidering ribbon sections from second ribbon layer 504 onto the backing layer 500 as well as over portions of first ribbon layer 502. For clarity, only two ribbon layers are shown; however, similar principles may be applied for embodiments comprising three or more layers.

Figure 6:
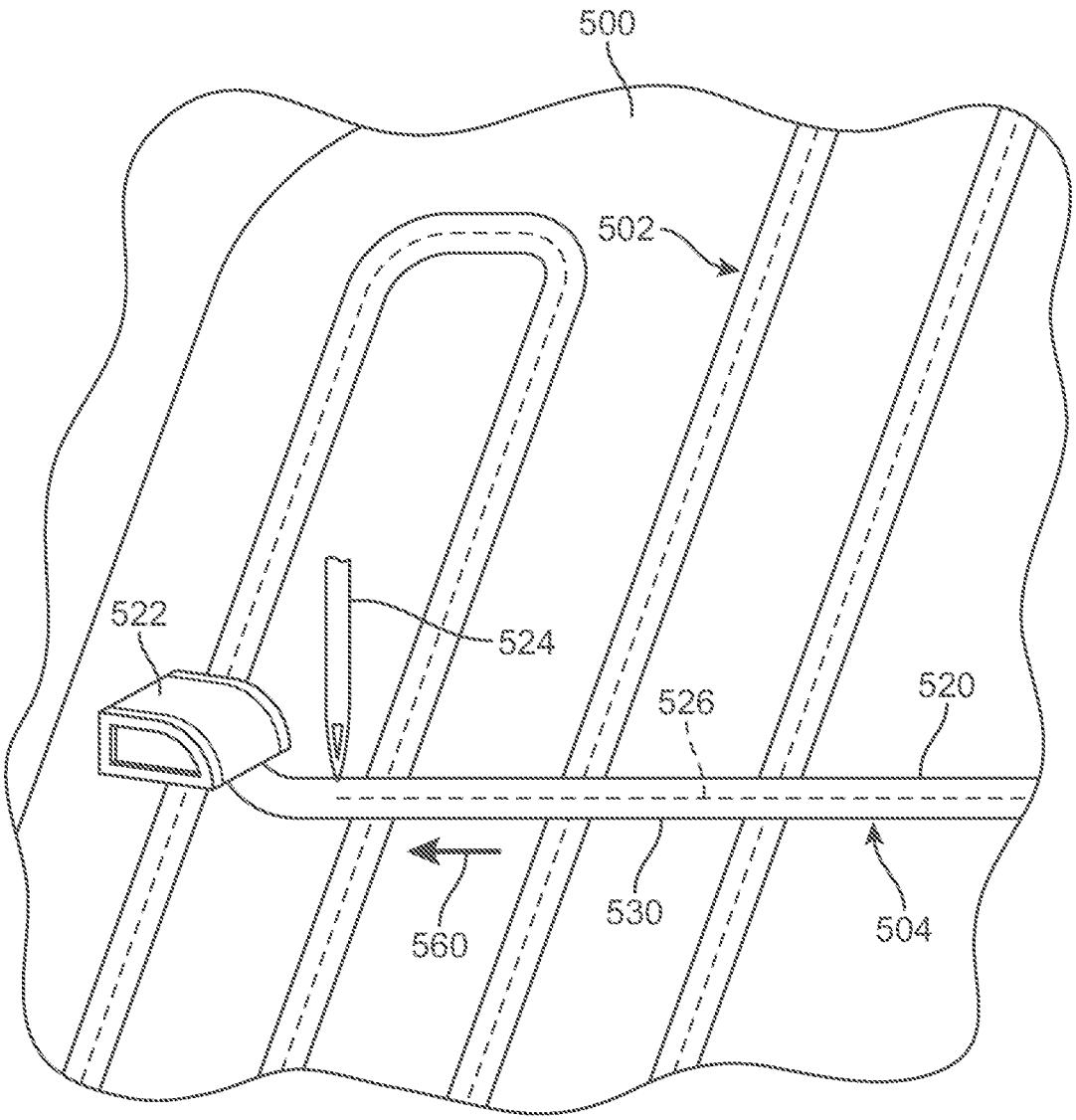
FIG. 6 is a schematic view of a process of forming a portion of an upper including multiple ribbons, according to an embodiment.

As seen in FIG. 6, ribbon 520 may be laid down on backing layer 500 (and across portions of first ribbon layer 502) using ribbon feeder 522. As ribbon 520 is laid down, embroidery needle 524 stitches thread 526 through ribbon 520 to fix ribbon 520 in place with respect to backing layer 500 and first ribbon layer 502. For purposes of illustration, both ribbon feeder 522 and embroidery needle 524 are shown schematically. Moreover, only the top thread (thread 526) is illustrated, though a bobbin thread may be disposed on an opposing side of backing layer 500. Thus it may be appreciated that the process of embroidering a ribbon section in place may include looping a top thread around a bobbin thread (or vice versa).

In some embodiments, the ribbon sections may be fixedly attached to one another and/or to underlying base layers (e.g., a mesh layer) using thermal bonding, such as the welding or thermoplastic polyurethane ribbons. Accordingly, the ribbon structures discussed herein can be formed using any of the procedures and configurations described in Luedecke, et al., U.S. Pat. No. 10,758,007, entitled "Article with Thermally Bonded Ribbon Structure and Method of Making" (U.S. application Ser. No. 16/026,683 filed on Jul. 3, 2018), the entire disclosure of which is incorporated herein by reference.

Figure 7:
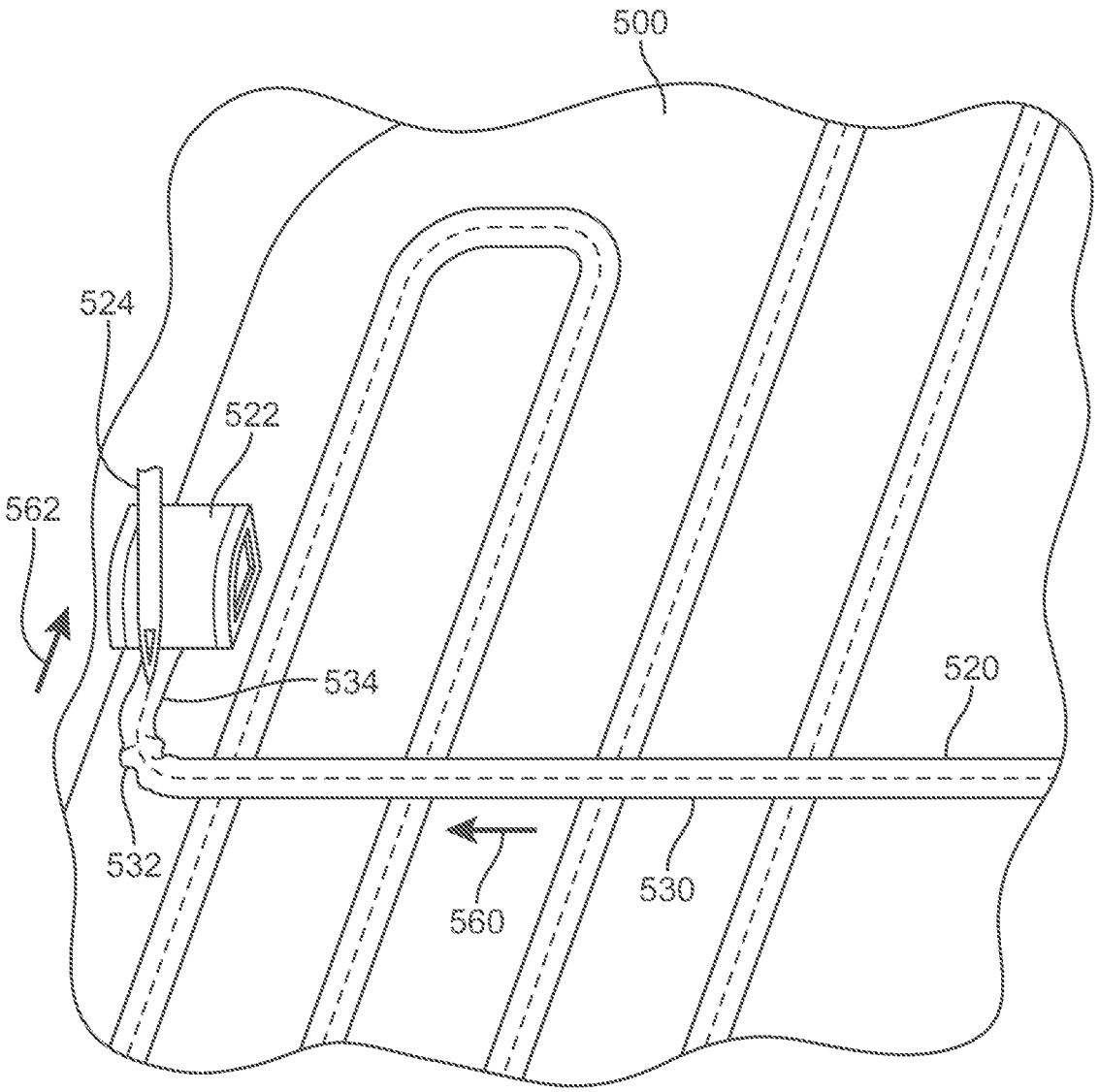
FIG. 7 is a schematic view of the process of FIG. 6 in which a ribbon feeder has turned as it lays down ribbon.

In FIG. 6, straight ribbon section 530 is laid down along first direction 560 and stitched in place. Next, as seen in FIG. 7, ribbon feeder 522 turns to form first corner section 532 and continues in second direction 562 to form intermediate straight section 534. As seen in FIG. 7, second direction 562 is oriented approximately perpendicular to first direction 560. Following this, as seen in FIG. 8, ribbon feeder 522 turns again to form second corner section 536 and then continues in third direction 564 that is parallel (and opposite to) first direction 560 to form another straight section 538.

Figure 8:
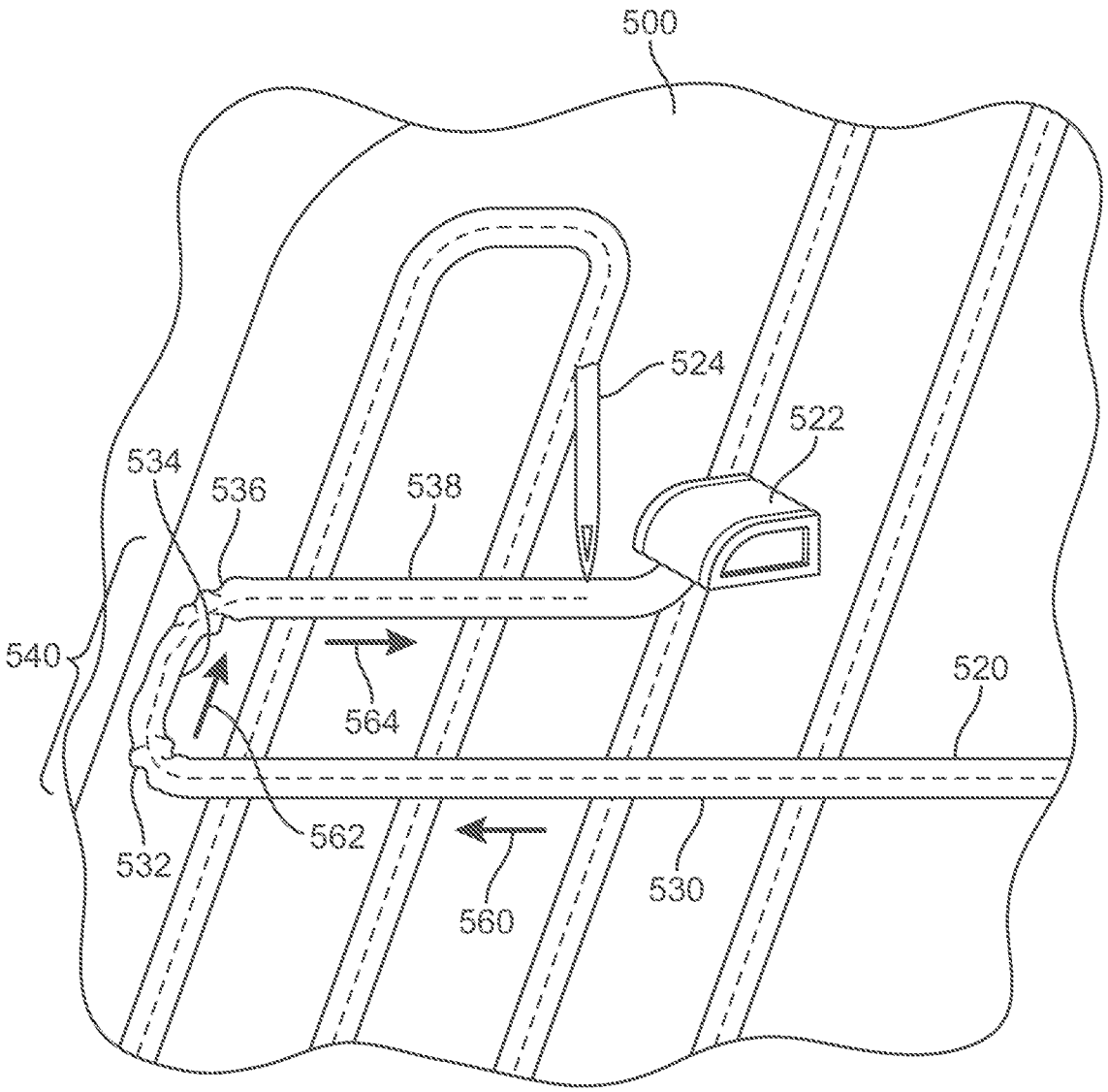
FIG. 8 is a schematic view of the process of FIG. 6 in which an open loop has been formed in a layer of ribbon, according to an embodiment.

As seen in FIG. 8, together first corner section 532, intermediate straight section 534, and second corner section 536 collectively form curved section 540 of ribbon 520. Moreover, although curved section 540 is comprised of corner sections and a straight intermediate section, other curved sections having a semicircular, elliptic, or any other kind of curvature could be used.

Although the ribbon shown in FIGS. 6-9 has a substantially uniform pattern, the ribbon may be arranged in any suitable pattern. For example, the embodiment shown in FIGS. 17-19, and discussed in further detail below, implements a non-uniform pattern.

As ribbon sections are curved, they may undergo various kinds of distortion, such as folding, bending, buckling, ruffling, pinching, and/or other kinds of deviations from the natural geometry of a straight ribbon section. Depending on the type of tension applied along a corner section, the ribbon could deform in various ways. In some cases, the inner edge of the curved section may tend to bunch or pinch, and the outer edge of the curved section may stretch and even pop up out of the plane of the ribbon layer. In other cases, curved portions may simply develop ruffles or folds along one or both of the inner and outer edges.

Figure 9:
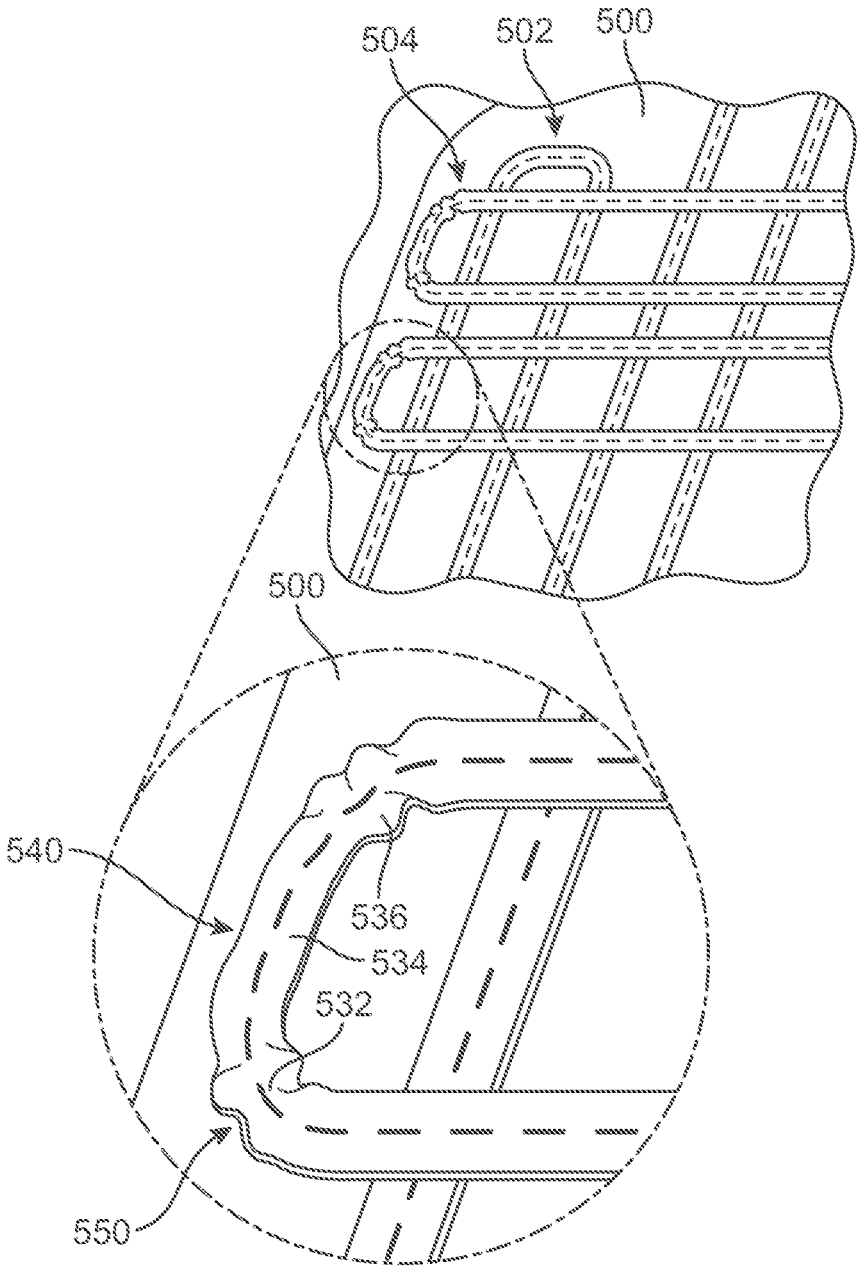
FIG. 9 is a schematic view of an embodiment of a portion of a ribbon structure including an enlarged view of a curved ribbon section that has ruffled.

FIG. 9 is a schematic view showing a portion of backing layer 500, first ribbon layer 502 and second ribbon layer 504. As seen in the enlarged view of FIG. 9, curved section 540 tends to buckle or ruffle as it resists curving along first corner section 532 and second corner section 536. This buckling or ruffling creates raised portions 550 (or folds) that bend up and away from backing layer 500.

Although FIG. 9 illustrates only two curved sections that undergo this distortion (e.g., buckling/ruffling), it may be appreciated that in some cases any and/or all curved sections in a ribbon structure may undergo similar buckling/ruffling.

The ruffling along the curved ribbon sections may create an uneven surface along the periphery of an upper. Some embodiments may therefore include provisions that help create a smoother peripheral surface.

Figure 10:
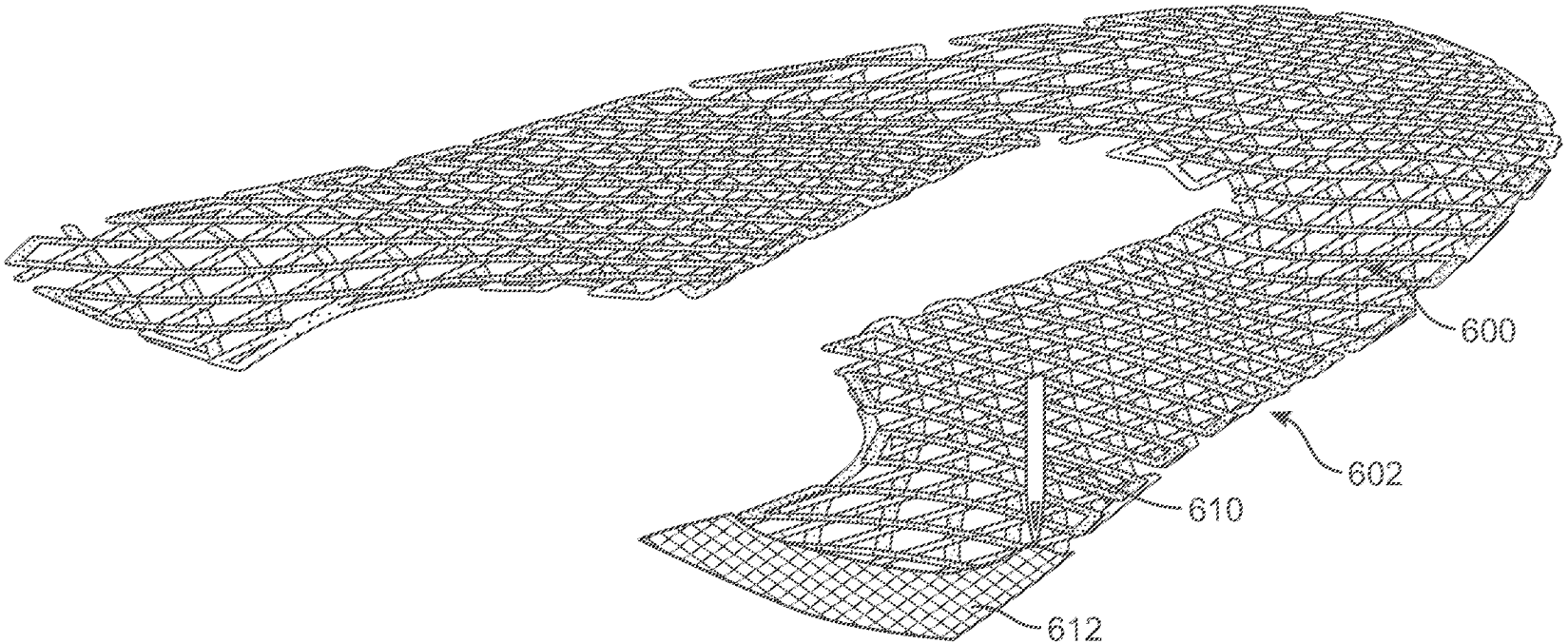
FIG. 10 is a schematic view of a process of embroidering a border element onto a ribbon structure, according to an embodiment.

FIG. 10 is a schematic view of a step of embroidering a border onto peripheral portion 602 of ribbon structure 600. In this case, embroidery needle 610 is used to form embroidered border element 612.

Figure 11:
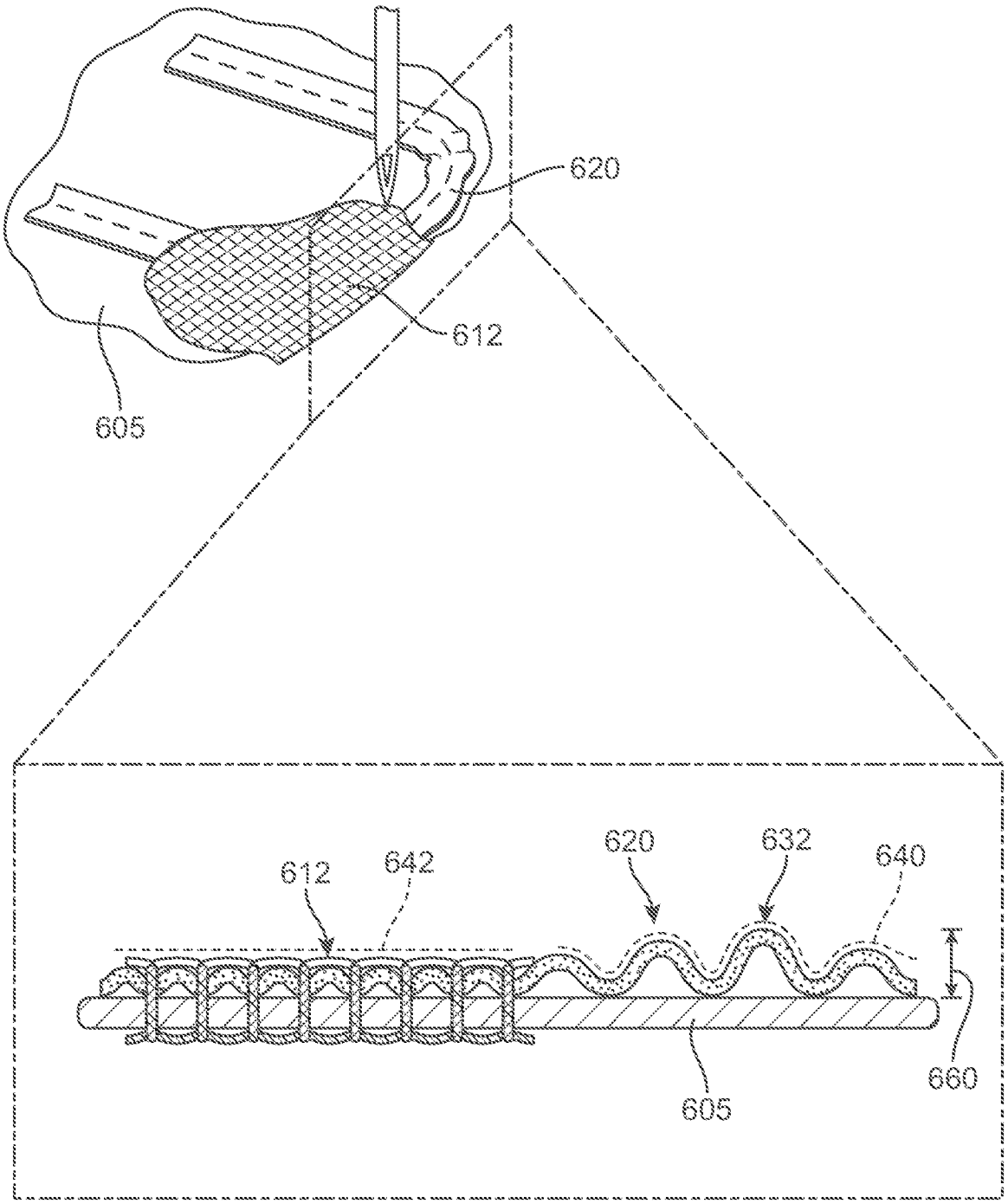
FIG. 11 is a schematic view of a process of embroidering a portion of a border element onto a curved ribbon structure, according to an embodiment.
Figure 12:
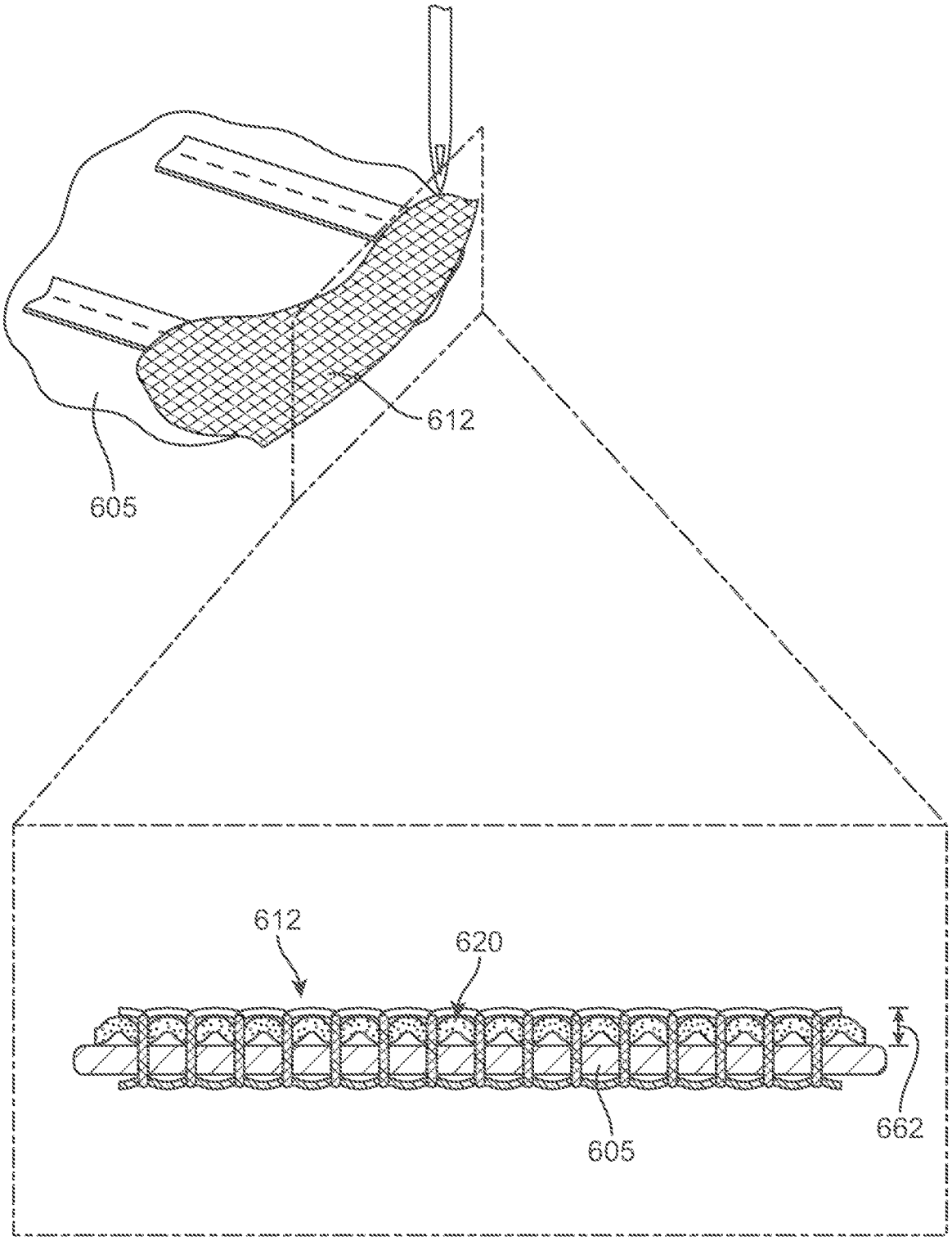
FIG. 12 is a schematic view of a process of embroidering a portion of a border element onto a curved ribbon structure, according to an embodiment.

FIGS. 11 and 12 illustrate schematic views of single curved ribbon section 620 as embroidered border element 612 is formed over single curved ribbon section 620. In the view shown in FIG. 11, approximately half of single curved ribbon section 620 has been embroidered over. As seen in FIG. 11, the exposed portion of single curved ribbon section 620 includes raised portions 632 that extend up and away from backing layer 605. These raised portions 632 form irregular surface 640. However, raised portions 632 of curved ribbon section 620 has been tacked down against backing layer 605 and has an approximately smooth and flat surface 642. After completing the embroidery of curved ribbon section 620, as seen in FIG. 12, the entire outer surface of this region is seen to be smooth.

Moreover, it may be seen by comparing FIGS. 11 and 12 that the maximum height that curved ribbon section 620 extends from backing layer 605 is reduced after curved ribbon section 620 is embroidered over (with border element 612). As seen in FIG. 11, prior to being covered by border element 612, curved ribbon section 620 has maximum height 660 (with respect to backing layer 605). After the embroidery is completed in FIG. 12, curved ribbon section 620 has maximum height 662 that is substantially less than maximum height 660. That is, the act of embroidering over curved ribbon section 620 pushes down the raised portions 632 of curved ribbon section 620.

Figure 13:
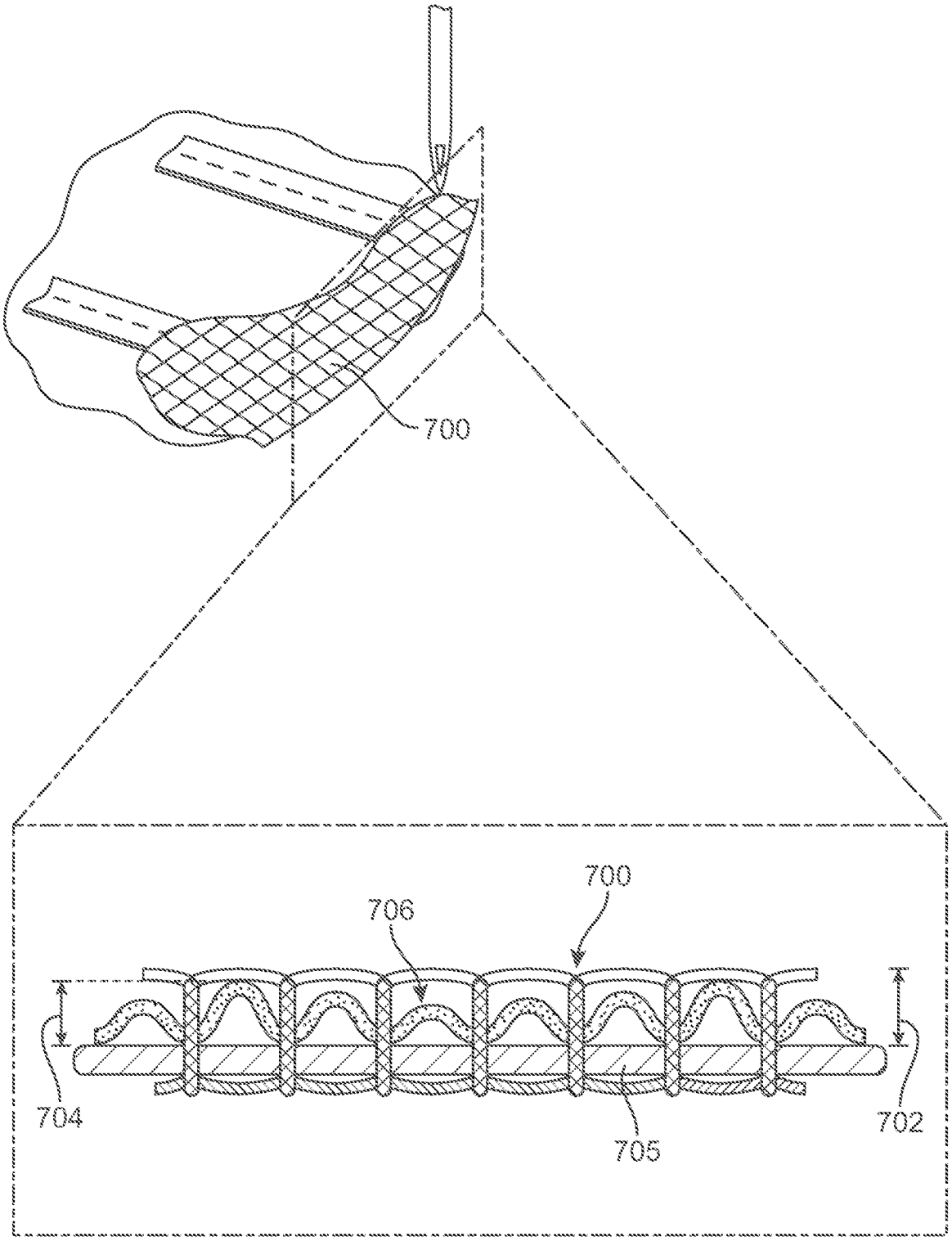
FIG. 13 is a schematic view of a process of embroidering a portion of a border element onto a curved ribbon structure, according to another embodiment.

Alternatively, in another embodiment, rather than acting to "tack down" the raised portions of a curved ribbon section, an embroidered border element could be formed with substantially long stitches that extend higher from a backing layer than any portions of the ribbon. For example, FIG. 13 is a schematic view of an embodiment where embroidered border element 700 covers ribbon section 706. As seen in the enlarged view, embroidered border element 700 has stitch height 702 (above backing layer 705) that is greater than or equal to maximum height 704 of any portions of ribbon section 706.

Curved ribbon sections may provide additional functionality along the periphery of an article of footwear. For example, curved ribbon sections may be used to form lace loops for an article of footwear. Additionally, or alternatively, as described in further detail below, in some embodiments, curved ribbon sections at the peripheral edge of the upper may form loops through which a lasting string may be threaded.

In contrast to strands or other substantially one-dimensional materials that may be used, for example, in meshes, ribbon or substantially two-dimensional pieces of material (e.g., strips) may better resist stretching under tension, especially in a longitudinal direction. In some cases, using ribbons may also help increase comfort due to the increased surface contact area between the ribbons and a foot (or overlying layer of the foot, such as a sock, or other liner in the footwear).

The exemplary embodiments provide an upper including a ribbon structure. A ribbon structure may be comprised of continuous lengths of ribbon arranged into a pattern of overlapping ribbon portions or sections. Using a continuous ribbon to form multiple ribbon sections may help improve the efficiency of manufacturing by reducing the number of times a machine laying and attaching ribbon needs to stop or pause, and/or by reducing the need to include steps of cutting ribbons (either as the ribbon is laid down and/or prior to this). Moreover, by using a continuous ribbon, the tendency of separate pieces of ribbon to separate at attachment points (e.g., stitching or welding points) may be reduced, resulting in increased strength and durability for the upper.

In some embodiments, a plurality of ribbon loops may be provided at the peripheral region of the upper to facilitate string lasting. As explained in greater detail with respect to FIG. 16, string lasting involves providing a piece of material to be formed into an upper of an article of footwear and mounting the piece of material onto a last, which is a form or molded element having the general size and shape of a foot. String lasting further includes using a string to tighten the piece of material around the last in order to assemble the footwear components into a complete shoe. That is, string lasting includes threading a lasting string through a plurality of loops at the peripheral edge of an upper (i.e., along the bottom edge to be fixedly attached to a sole structure), then pulling the string tight to snugly fit the piece of upper material around the last. Once the piece of upper material is snugly mounted on the last, the upper may be fixedly attached to a strobel and/or to a sole structure.

In some embodiments, ribbon may be used for lasting loops through which lasting string may be threaded. Using ribbon for lasting loops provides several advantages. For example, using ribbon enables a loop to be formed with a greater amount of material (e.g., a larger cross-sectional area), without increasing thickness. This minimizes any undulations or bumps that must be covered over at the peripheral edges of the upper and between the insole and the sole structure. Thus, stronger lasting loops can be utilized without any additional penalty in terms of the thickness of the loops as compared to simply using a heavier duty loop with a circular cross-section (e.g., string, cable, cord, etc.). Ribbon loops can also be conveniently formed when portions of the upper are formed of ribbon as well. Accordingly, manufacturing efficiencies can be realized by using ribbon lasting loops.

Figure 15:
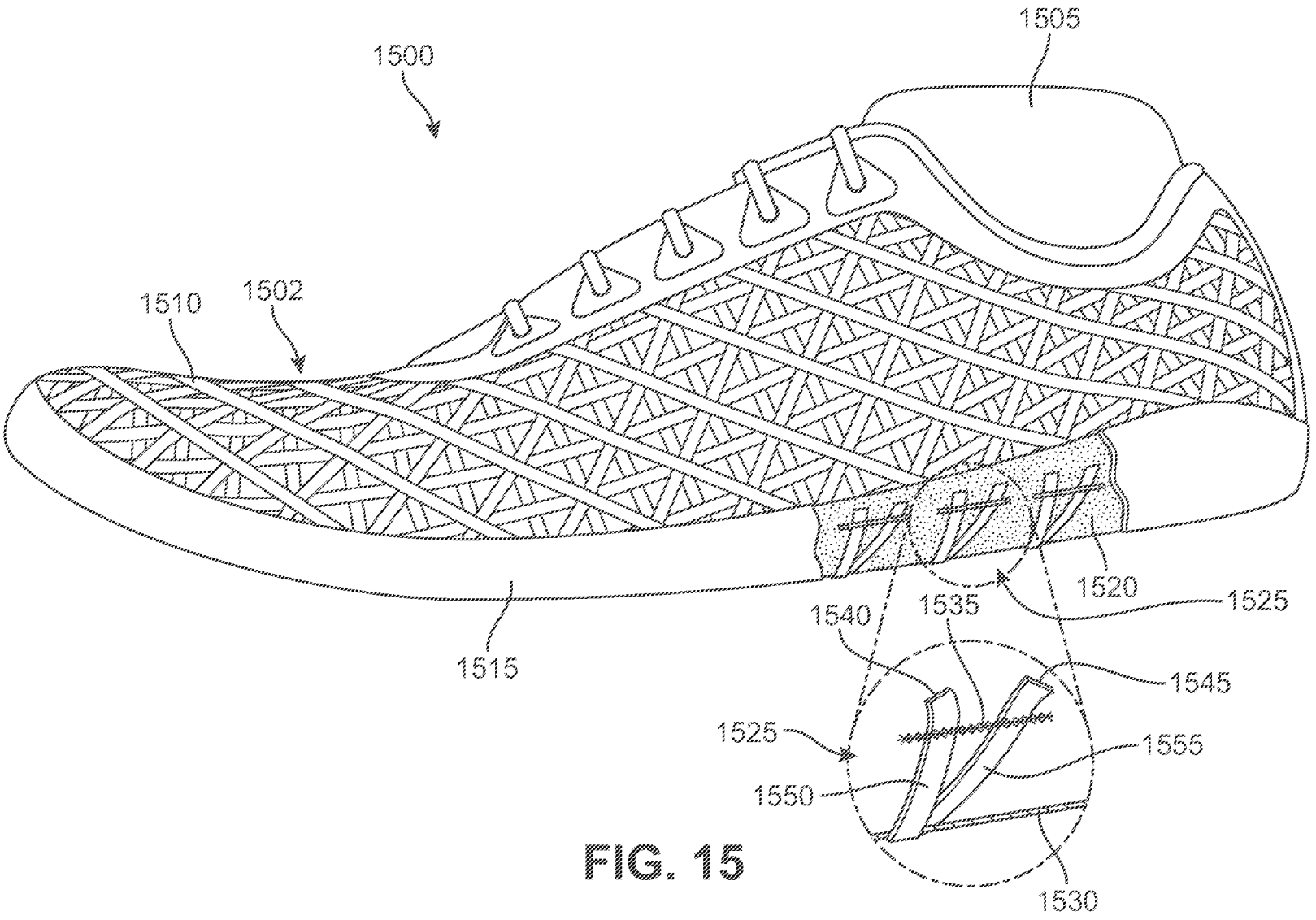
FIG. 15 is a schematic side view of an upper of an article of footwear according to another embodiment.

FIG. 15 is a schematic side view of an upper of an article of footwear that includes ribbon lasting loops. As shown in FIG. 15, an article of footwear 1500 may include an upper 1502 which, when assembled, is configured to receive a foot of a wearer. Upper 1502 may be secured to a sole structure (not shown). Any suitable method may be used to secure the sole structure to upper 1502. For example, adhesive, thermal bonding, stitching, or any other method of fixedly attaching a sole structure to an upper.

As shown in FIG. 15, during assembly of footwear 1500, upper 1502 is mounted on a last 1505. As also shown in FIG. 15, upper 1502 includes a ribbon structure 1510 formed of a plurality of ribbon sections. Ribbon structure 1510 may have any suitable configuration, including other configurations discussed herein or other configurations suitable for the intended use of the footwear being produced. For example, the ribbon sections of ribbon structure 1510 overlap one another. In some embodiments, the ribbon sections that overlap one another are fixedly attached to one another by embroidery stitching (see, e.g., FIG. 6).

Upper 1502 includes a peripheral region 1515. At peripheral region 1515, upper 1502 may include a border element 1520. Border element 1520 covers over the edge region of the ribbon structure and generally secures the ribbon sections in place relative to one another. Border element 1520 may have any suitable configuration, including, for example, the configurations discussed herein. For instance, border element 1520 may be formed of embroidery stitching.

In addition to fixing the edges of the ribbon sections, border element 1520 may provide a sturdy base upon which a plurality of lasting loops may be fixedly attached. For example, as shown in FIG. 15, a plurality of lasting ribbon loops may include a first ribbon loop 1525 fixedly attached to upper 1502 in the peripheral region 1515. It will be noted that ribbon loops may be provided around the entire periphery of upper 1502 (see FIG. 16). In FIG. 15, a generic outer covering is provided in peripheral region 1515 to cover over the separately attached ribbon loops. In FIG. 15, a portion of this outer covering is removed in order to expose several of the ribbon loops.

In some embodiments, the ribbon lasting loops may be separate components that are fixedly attached to the upper. By using separate, attachable loops, the loops can be used regardless of what material is used to construct the upper. Such loops can be used on an upper that is formed of any material, whether it includes a ribbon structure or not. Further, by separately attaching ribbon loops, the placement of the ribbon loops may be selected based on what is best for string lasting irrespective of how the ribbon segments of the ribbon structure are disposed to form the upper. Further, a greater or lesser number of ribbon loops may be used if the loops are separate, attachable components.

As shown in FIG. 15, a lasting string 1530 is threaded through the plurality of ribbon loops, including first ribbon loop 1525. In some embodiments, the ribbon loops are separate components that are fixedly attached to peripheral region 1515 of upper 1502. Any suitable method of fixedly attaching the ribbon loops may be used. For example, as shown in FIG. 15, embroidery stitching 1535 is used to fixedly attach first ribbon loop 1525 to peripheral region 1515 of upper 1502.

In some embodiments, the ribbon loops may formed by folding lengths of ribbon. This prevents buckling at the apex of the loops. For example, as shown in FIG. 15, first ribbon loop 1525 includes a first end 1540, a second end 1545, a first flat surface 1550, and a second flat surface 1555 opposite first flat surface 1550. At first end 1540 of first ribbon loop 1525, first ribbon loop 1525 is oriented with second flat surface 1555 facing the upper and, at second end 1545 of first ribbon loop 1525, first flat surface 1550 facing upper 1502.

Figure 16:
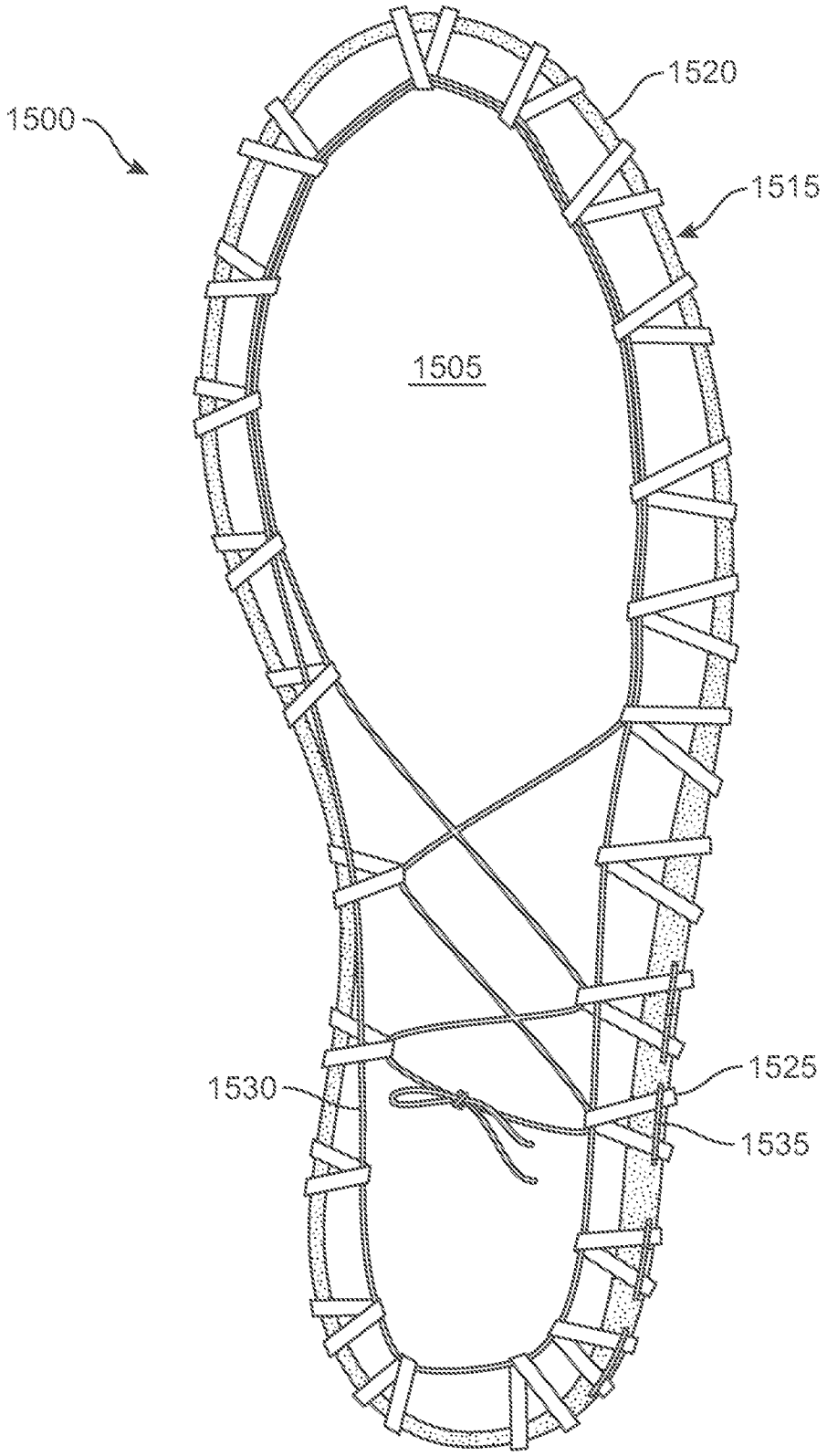
FIG. 16 is a schematic bottom view of the embodiment shown in FIG. 15.

FIG. 16 is a schematic bottom view of the embodiment shown in FIG. 15. As shown in FIG. 16, lasting string 1530 is threaded through the plurality of ribbon loops and pulled tightly to draw the ribbon loops inward to snugly fit the upper around last 1505. While embroidery stitching is only shown on some of the ribbon loops in FIG. 16, it will be understood that some or all of the ribbon loops may be fixedly attached to upper 1502 with embroidery stitching 1535. In this bottom view, not all of the embroidery stitching is necessarily visible.

Any suitable construction may be used for the lasting string. For example, lasting string may be formed of monofilament, woven or braided threads or cables, twisted fibers, or any other construction having the desired tensile strength and inelasticity. Various materials may be used, including natural materials, such as cotton, synthetic materials, such as nylon, or other polymers, various metals, and any other material having the desired strength, weight, size, and/or flexibility properties.

Figure 19:
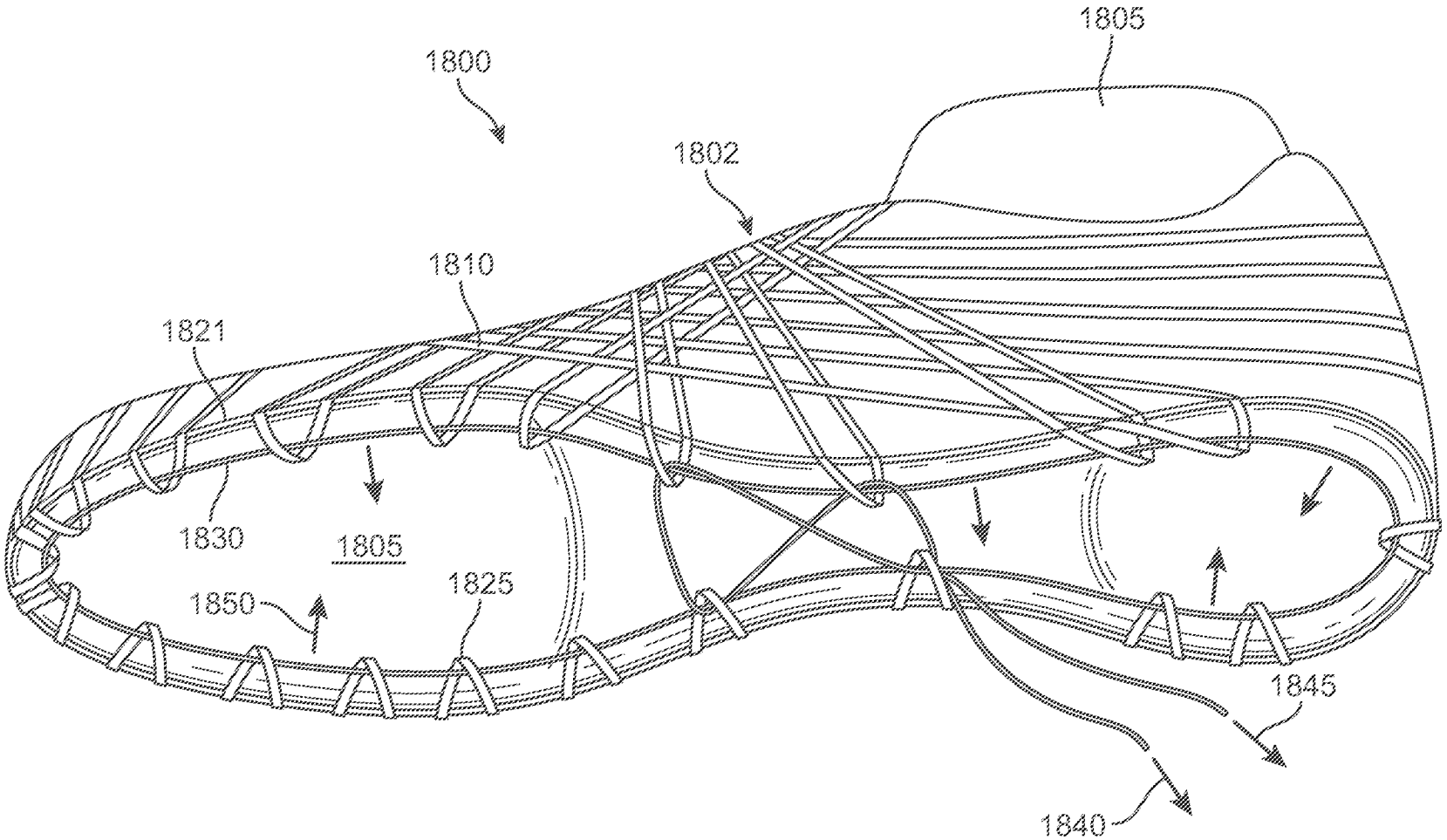
FIG. 19 is a schematic bottom perspective view of the upper shown in FIG. 18 mounted on a last.
Figure 20:
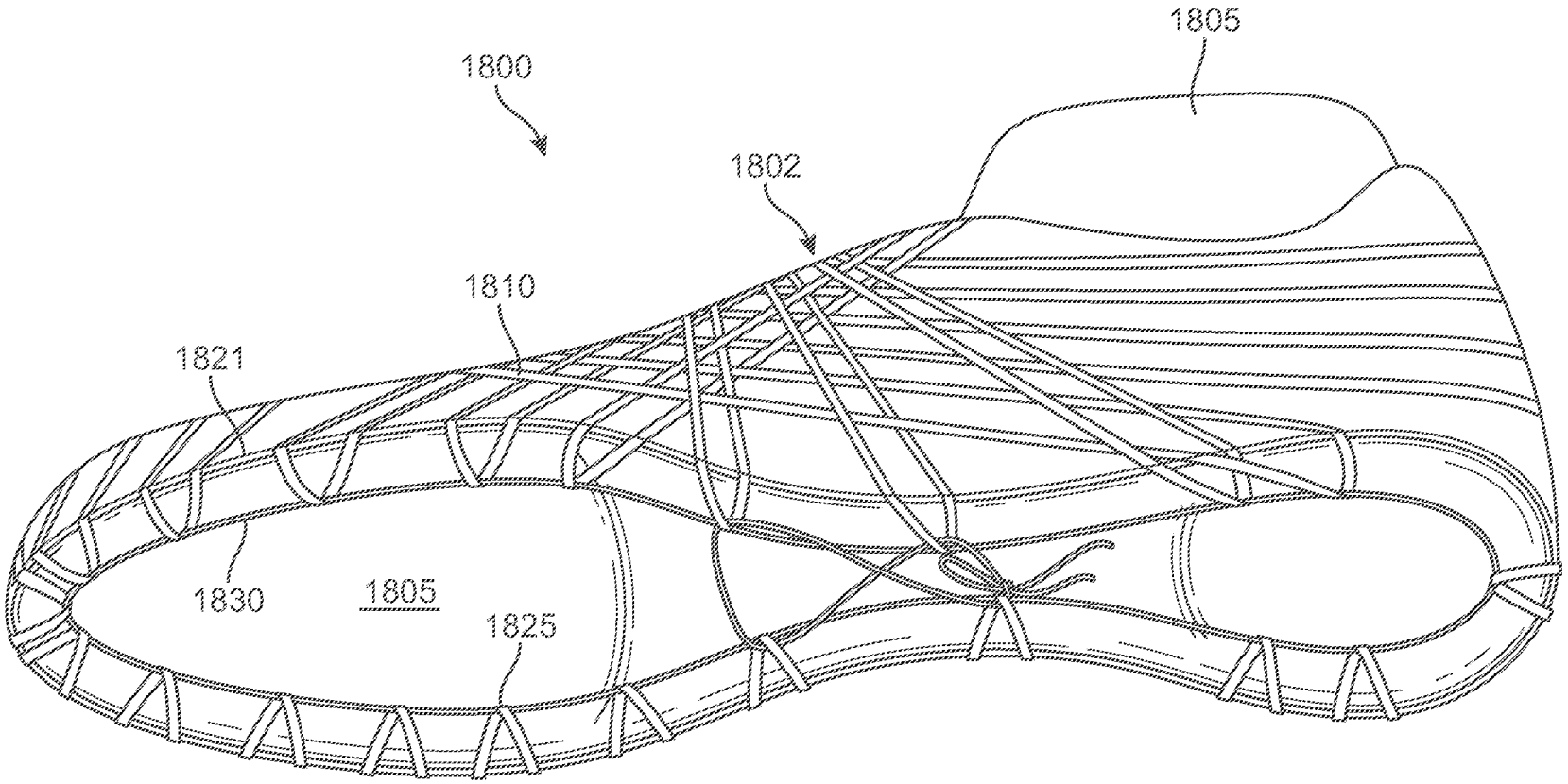
FIG. 20 is a schematic bottom perspective view of the upper on the last shown in FIG. 19, with a lasting string tightened.

It will be understood that the threading and arrangement of the lasting strings discussed herein can vary. In some cases, the string may only circle the perimeter of the sole region. In other cases, the lasting string may be passed back and forth across the sole in one or more locations, as shown in FIGS. 19 and 20. Such laterally threaded lasting string may facilitate drawing the edges of the upper together in narrow portions of the sole, such as the midfoot region.

In some cases, the lasting string may be threaded through the same ribbon loop more than once. For example, in one or more areas of the sole, the lasting string may be doubled up as it passes through the ribbon loops. In some embodiments, one region of the sole may have doubled lasting string through the loops and another region of the same sole may have the lasting string passing through the loops only once. For example, in some cases the lasting string may be doubled up in the forefoot region, but single-threaded in the heel region. In such embodiments, the lasting string may extend across the midfoot region from the medial side of the footwear to the lateral side of the footwear.

The flatness and/or folded configuration of ribbon loops may facilitate double threading of lasting string. Because of the flatness and/or folded configuration of ribbon loops, the lasting string may lie side-by-side when doubled up, instead of vertically stacked. In addition, even if the double-threaded lasting string does stack vertically in certain places, the flatness of the ribbon loops may ensure that the combined thickness of the string and loops may not be unduly large.

In some embodiments, the lasting string may cross over itself in the midfoot region. In some cases, the lasting string may cross over itself more than once in the midfoot region. The lasting string crossing over itself may be arranged due to diagonal threading of the lasting string across the midfoot region. That is, threading of the lasting string at an angle with respect to the medial-lateral direction, similar to lacing a traditional footwear vamp closure may produce overlapping portions of lasting string. Tightening a diagonal-threaded lasting string, and the consequent pulling on the ribbon loops, may draw the edges of the upper in a direction that is substantially perpendicular to the edge of the sole region at the location of each ribbon loop. Since the perimeter of a footwear sole is typically contoured, diagonal threading of lasting string may produce a more evenly distributed lasting draw than lasting string that is threaded directly across the sole in the medial-lateral direction.

As shown in FIG. 16, in a forefoot region 1600, footwear 1500 includes a plurality of forefoot ribbon loops. For example, in forefoot region 1600, footwear 1500 includes a first forefoot ribbon loop 1601, a second forefoot ribbon loop 1602, a third forefoot ribbon loop 1603, and a fourth forefoot ribbon loop 1604 on the medial side of footwear 1500. In addition, footwear may include a fifth forefoot ribbon loop 1605 disposed proximate a toe area, or forwardmost end of footwear 1500. Further, as shown in FIG. 16, in forefoot region 1600, footwear 1500 includes a sixth forefoot ribbon loop 1606, a seventh forefoot ribbon loop 1607, an eighth forefoot ribbon loop 1608, a ninth forefoot ribbon loop 1609, and a tenth forefoot ribbon loop 1610 on the lateral side of footwear 1500. As shown in FIG. 16, lasting string 1530 is double threaded through the ribbon loops of forefoot region 1600, as illustrated by a double-threaded portion 1640 of lasting string 1530.

As also shown in FIG. 16, footwear 1500 includes a midfoot region 1620 that includes a first midfoot ribbon loop 1621, a second midfoot ribbon loop 1622, a third midfoot ribbon loop 1623, a fourth midfoot ribbon loop 1624, a fifth midfoot ribbon loop 1625, a sixth midfoot ribbon loop 1626 and a seventh midfoot ribbon loop represented by ribbon loop 1525.

As shown in FIG. 16, in midfoot region 1620, lasting string is diagonally threaded across the midfoot portion of the sole in several places. Due to this diagonal threading, lasting string 1530 crosses over itself in a first location 1645 and a second location 1650.

In addition, once tightened, lasting string 1530 is secured to maintain the tension produced in lasting string 1530 during assembly of the shoe. For example, as shown in FIG. 16, a knot 1655 secures the ends of lasting string 1530 to one another so that lasting string 1530 does not become unthreaded. In other embodiments, lasting string may be secured in other ways, such as by tying it to a lasting loop, securing it to the peripheral portion of the upper with adhesive, or any other suitable way to ensure that the tension is maintained in the lasting string.

As also shown in FIG. 16, footwear 1500 includes a heel region 1630. In heel region 1630, footwear 1500 includes a first heel ribbon loop 1631, a second heel ribbon loop 1632, a third heel ribbon loop 1633, a fourth heel ribbon loop 1634, a fifth heel ribbon loop 1635, and a sixth heel ribbon loop 1636. As shown in FIG. 16, lasting string 1530 is single-threaded through the loops of heel region 1630, as illustrated by a single-threaded portion 1641 of lasting string 1530.

During lasting, the peripheral portion of the upper is wrapped around a last and fixedly attached to a strobel and/or a sole structure. In order to draw the upper tightly around the last for fixed attachment to the strobel or sole structure, a lasting string may be threaded through the plurality of ribbon loops, and pulled tight. Once the lasting string is pulled tightly, the peripheral portion of the upper may be fixedly attached to a strobel or to a sole structure.

In some embodiments, the lasting string may be left in place such that it becomes part of the assembled shoe. In other embodiments, the shoe may be assembled in a manner such that the lasting string is removable. For example, in some embodiments, portions of the ribbon loops may be left unattached to the strobel or sole structure. Because the loops are unattached, the lasting string may also be unattached, and thus, may be removed (unthreaded) from the loops. Removing the lasting string, may save weight, provide for a smoother footbed for the article of footwear, and/or may better expose the strobel and/or upper for attachment of a sole structure.

Further, the lasting string may be removed during or after assembly in a different manner. For example, in some embodiments, the lasting string may be formed of a dissolvable material. By dipping the footwear assembly in a solution, the lasting string may be dissolved.

In some cases, one or more of the ribbon loops may be formed of end portions of the ribbon sections forming the ribbon structure of an upper. In such a configuration, the lasting loops may be formed without taking additional steps beyond those used to form the main body of the upper (aside from leaving a little extra length at the ends of the ribbon sections to form the loops extending from the peripheral edge of the upper). The properties of the ribbon sections used to form the ribbon structure include significant strength as these ribbon sections must support the foot as part of the upper. Accordingly, the strength of these ribbon sections may also be suitable for use in lasting loops.

Figure 17:
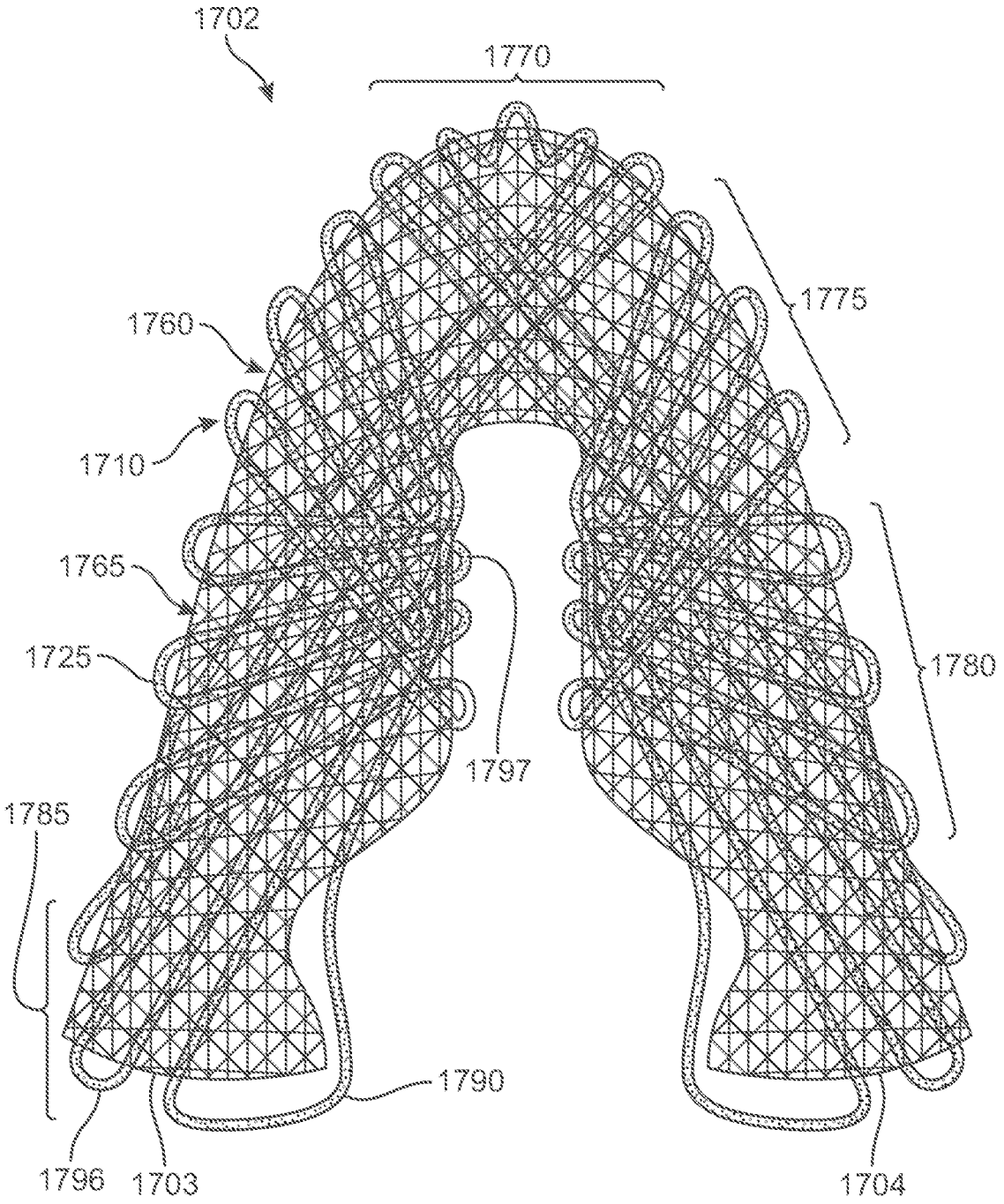
FIG. 17 is a schematic pre-assembly view of an upper of an article of footwear according to another embodiment.

FIG. 17 is a schematic pre-assembly view of an upper of an article of footwear according to an embodiment having ribbon loops for string lasting. As shown in FIG. 17, an upper or piece of upper material 1702 is formed of a ribbon structure 1710 formed of a plurality of ribbon sections. Ribbon structure 1710 may have any suitable configuration. In some embodiments, the ribbon sections of ribbon structure 1710 may overlap in various configurations.

As shown in FIG. 17, ribbon structure 1710 may have ribbon sections arranged in various orientations to form different regions of upper 1702. For example, a collection of radial ribbon sections are formed in a toe region 1770. In addition, a plurality of forward-angled ribbon sections are formed in a forefoot region 1775. Also, a plurality of rearward-angled ribbon sections are formed in a midfoot section 1780.

A heel section 1785 is also shown with ribbon loops, such as a first heel loop 1790 and a second heel loop 1796. First heel loop 1790 and second heel loop 1796 are not lasting loops. When upper 1702 is assembled, first heel edge 1703 and second heel edge 1704 are joined to one another. Thus, first heel loop 1790 and second heel loop 1796 do not extend off the bottom of upper 1702 and, therefore, cannot be used for string lasting. These loops are formed simply as a consequence of forming the pattern of ribbon sections to form the ribbon structure and are cut off prior to assembly of the shoe.

In some cases, the ribbon sections that overlap one another are fixedly attached to one another by embroidery stitching. In some embodiments, the ribbon structure may be formed on a substrate layer, such as a mesh layer. The mesh layer provides a lightweight, breathable layer to which the ribbon sections may be secured to maintain their arrangement with respect to one another while the footwear is being formed. The ribbon structure may be fixedly attached to the mesh layer using any suitable method. For example, the ribbon structure may be fixedly attached to the mesh layer using embroidery stitching, adhesive, thermal bonding, and/or other attachment methods.

As shown in FIG. 17, upper 1702 includes a mesh layer 1760. Embroidery stitching 1765 fixedly attaches ribbon structure 1710 to mesh layer 1760. The arrangement of embroidery stitching 1765 may follow any suitable pattern to secure the ribbon sections to mesh layer 1760 as desired.

As shown in FIG. 17, upper 1702 incudes a plurality of ribbon loops 1725 extending from the peripheral region of upper 1702. It will also be noted that such loops extending from edges of the upper may form eyelets for lacing, such as lacing loops 1797.

As shown in FIG. 17, the ribbon loops 1725 are formed of end portions of the ribbon sections forming ribbon structure 1710. As also shown in FIG. 17 ribbon loops 1725 are substantially flat. That is, the ribbon sections forming these loops simply turn and extend in the opposite direction. The ribbon does not fold on itself in order to change directions. This arrangement may facilitate the manufacturing of ribbon structure 1710. If the ribbon used to form ribbon structure 1710 is somewhat elastic or particularly flexible, these loops may be formed flat without significant buckling of the ribbon.

Figure 18:
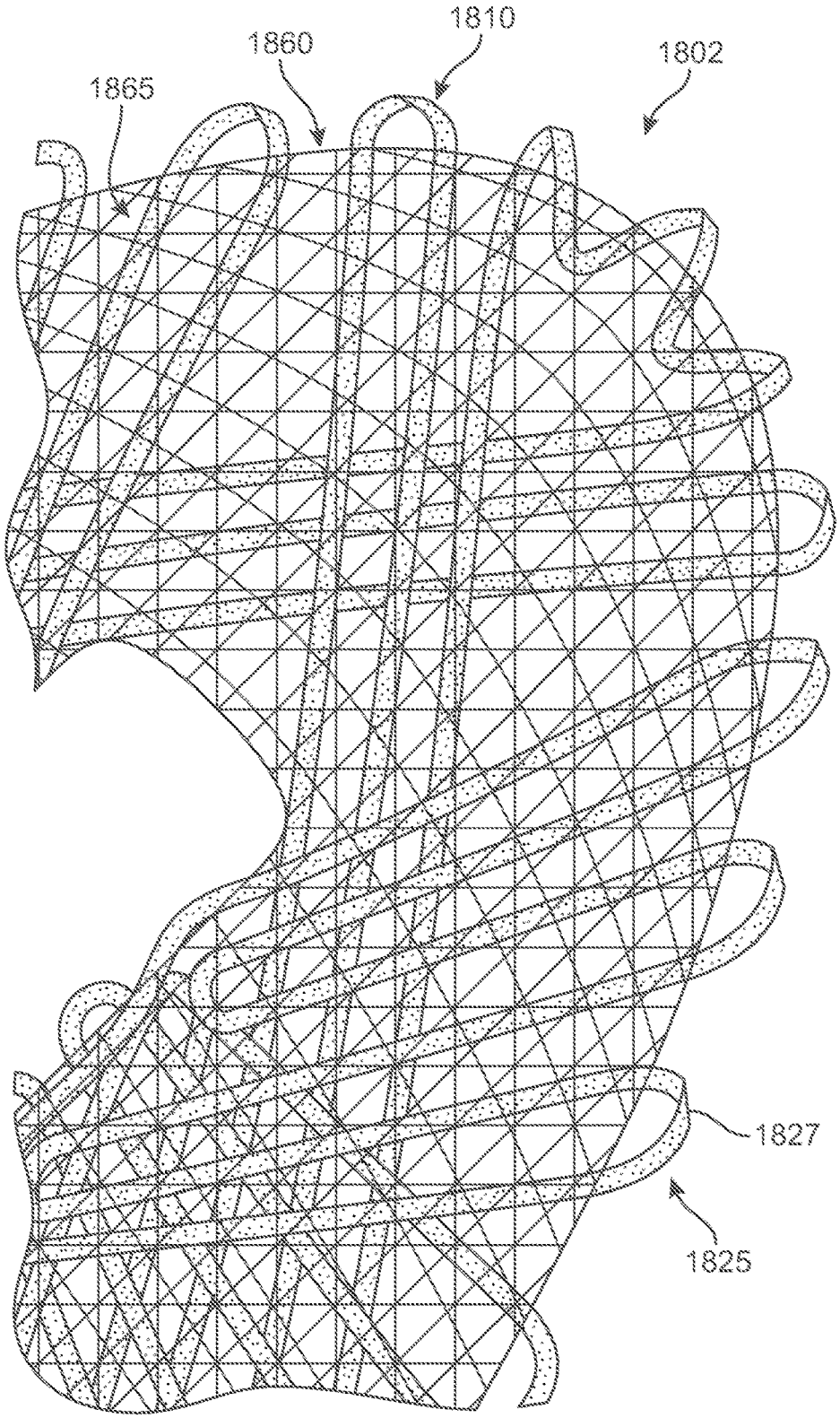
FIG. 18 is a schematic pre-assembly view of an upper of an article of footwear according to another embodiment.

In some cases, however, a configuration like that shown in FIG. 17 may be used but with folded lasting loops. FIG. 18 is an embodiment similar to that shown in FIG. 17, but with folded lasting loops. As shown in FIG. 18, an upper or piece of upper material 1802 includes a ribbon structure 1810. In some embodiments, ribbon structure 1810 is mounted on a mesh layer 1860 using any suitable method. For example, in some embodiments, ribbon structure 1810 is fixedly attached to mesh layer 1860 with embroidery stitching 1865, as shown in FIG. 18.

FIG. 18 further shows that ribbon structure 1810 includes a plurality of ribbon loops 1825. One or more of ribbon loops 1825 can have folded ends 1827, such that each loop has a first end, a second end, a first flat surface, and a second flat surface opposite the first flat surface; and at the first end of the first ribbon loop, the first ribbon loop is oriented with the first flat surface facing the upper and, at the second end of the first ribbon loop, the second flat surface facing the upper. (See FIG. 15.)

FIG. 19 is a schematic bottom perspective view of the upper shown in FIG. 18 mounted on a last 1805 and being assembled to form an article of footwear 1800. As shown in FIG. 19, a method of manufacturing an article of footwear may include forming a piece of upper material including a ribbon structure formed by a plurality of ribbon sections, the piece of upper material having a shape configured to form an upper for an article of footwear. Various iterations of this process are discussed in greater detail above. Using such processes, upper or piece of upper material 1802 is formed.

The method further includes mounting the piece of upper material 1802 onto last 1805. The method also includes drawing peripheral edges 1821 of the piece of upper material 1802 toward one another at the bottom of last 1805 by performing a string lasting process.

The string lasting process includes threading a lasting string 1830 through a plurality of ribbon loops 1825 extending from the peripheral region of the piece of upper material 1802. In addition, the string lasting process further includes pulling lasting string 1830 to tighten the piece of upper material 1802 around last 1805. As shown by a first arrow 1840 and a second arrow 1845, lasting string 1830 may be pulled to tighten the upper on last 1805. This tightening is indicated by a series of arrows 1850 illustrating the inward pull imparted by lasting string 1830.

As shown in FIG. 19, lasting string 1830 is single-threaded through the loops of footwear 1800 in the forefoot region and the heel region. In the midfoot region, lasting string 1830 extends across the sole region from the medial side to the lateral side. In particular, lasting string 1830 is diagonally threaded across the sole region through a first midfoot ribbon loop 1865, a second midfoot ribbon loop 1870, a third midfoot ribbon loop 1875, and a fourth midfoot ribbon loop 1880. Due to this diagonal threading, lasting string 1830 crosses over itself in a single crossover location 1860. The midfoot configuration of lasting string 1850 is a figure-eight pattern.

FIG. 20 is a schematic bottom perspective view of the upper on the last shown in FIG. 19, with lasting string 1830 tightened and tied off. It will be noted that the perimeter formed by lasting string 1830 bounds a smaller area than shown in FIG. 20, indicating the tightened condition of upper 1802 on last 1805.

Further, the string lasting process includes securing lasting string 1830 to maintain at least some of the tension produced in lasting string 1830. For example, as shown in FIG. 20, lasting string 1830 is secured with a knot 1855. Other methods of securing lasting string 1830 may also be used instead of, or in conjunction with, knot 1855.

Once the upper has been firmly fitted and tightened on last 1805 using the string lasting process, the method includes securing a sole structure to the piece of upper material 1802. The sole structure may be fixedly attached to upper 1802 using any suitable method, such as adhesives, thermal bonding, stitching, or any other fixation method.

In some embodiments, forming the piece of upper material includes fixedly attaching the plurality of ribbon loops to the peripheral region of the upper. (See FIGS. 15 and 16.) In such embodiments, fixedly attaching plurality of ribbon loops to the peripheral region of the upper includes attaching separate ribbon loops to the peripheral region of the piece of upper material with embroidery stitching.

In other embodiments, such as FIGS. 17-20, forming the piece of upper material includes forming one or more of the plurality of ribbon loops from end portions of the ribbon sections forming the ribbon structure.

In either configuration (i.e., separate or integral loops), the process of forming at least one of the plurality of ribbon loops may include folding a ribbon section such that the ribbon section has a first end, a second end, a first flat surface, and a second flat surface opposite the first flat surface and, at the first end of the ribbon loop, the second flat surface of the ribbon section faces the piece of upper material and, at the second end of the ribbon loop, the first flat surface of the ribbon section faces the piece of upper material. FIGS. 18-20 illustrate such folded loops.

During lasting, the peripheral portion of the upper is wrapped around a last and fixedly attached to a strobel and/or a sole structure. In order to draw the upper tightly around the last for fixed attachment to the strobel, a lasting string may be threaded through the plurality of ribbon loops, and pulled tight. Once the lasting string is pulled tightly, the peripheral portion of the upper may be fixedly attached to a strobel or to a sole structure, leaving the embroidered loops unattached to the strobel or sole structure. Because the loops are unattached, the lasting string may be removed (unthreaded) from the loops. Removing the lasting string, may save weight, provide for a smoother footbed for the article of footwear, and/or may better expose the strobel and/or upper for attachment of a sole structure.

Figure 21:
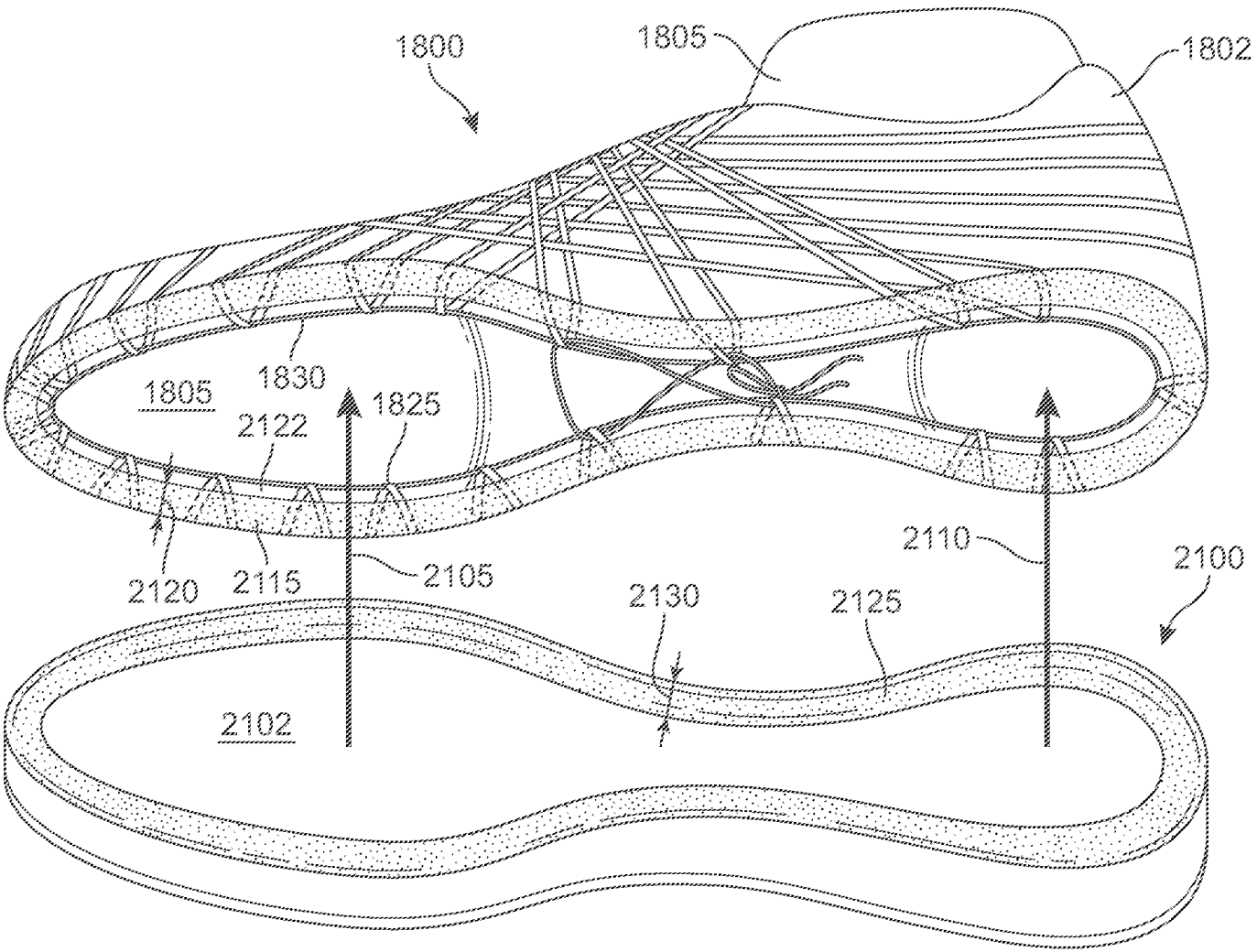
FIG. 21 is a schematic exploded view illustrating an assembly process of attaching a sole structure to a lasted upper.

FIG. 21 is a schematic exploded view illustrating an assembly process of attaching a sole structure to a lasted upper. FIG. 21 shows footwear 1800, including upper 1802 mounted on last 1805. FIG. 21 also shows a sole structure 2100 prior to fixed attachment to the bottom of upper 1802. That is, an upper surface 2102 of sole structure 2100 may be pressed against the bottom of upper 1802 as illustrated by a first arrow 2105 and a second arrow 2110.

As shown in FIG. 21, upper 1802 may be fixedly attached to sole structure 2100 only in a peripheral region. FIG. 21 shows stippled peripheral regions on upper 1802 and on sole structure 2100 that are to be attached to one another, for example by adhesive, thermal bonding, and/or other attachment methods. In particular, FIG. 21 shows an upper bonding region 2115 and a sole bonding region 2125.

Upper bonding region 2115 may have a first width dimension 2120, which corresponds to a second width dimension 2130 of sole bonding region 2125. As shown in FIG. 21, first width dimension 2120 of upper bonding region 2115 may be narrow enough that it does not cover ribbon loops 1825 completely, thus leaving a portion of each ribbon loop unattached to sole structure 2100 (or to a strobel). Accordingly, lasting string 1830 may also be unattached to sole structure 2100 (or to a strobel). This is illustrated in FIG. 21 by a gap 2122 between the edge of upper bonding region 2115 and lasting string 1830. Since lasting string 1830 is unattached, lasting string 1830 may be removed after attachment of sole structure 2100 to upper 1802. In embodiments where a strobel is not used, lasting string 1830 may be removed from inside footwear 1800, i.e., through the ankle opening. In embodiments where a strobel is used, lasting string 1830 may be removed after attachment of upper 1802 to the strobel. Subsequently, the sole structure may be attached to the upper that is already bonded to the strobel.

In some embodiments, an article of footwear may include an upper that is formed, at least in part, from embroidered material, and has a plurality of embroidered loops at the peripheral edge of the embroidered material forming the upper. Such embodiments may also include ribbon sections incorporated into the embroidered upper material. Such ribbon sections may stop short of the peripheral edge of the upper. Accordingly, such ribbon sections may be part of the peripheral portion of the upper that is fixedly attached to the strobel, which provides strength, by anchoring the structural ribbon sections to the sole region of the article of footwear.

Figure 22:
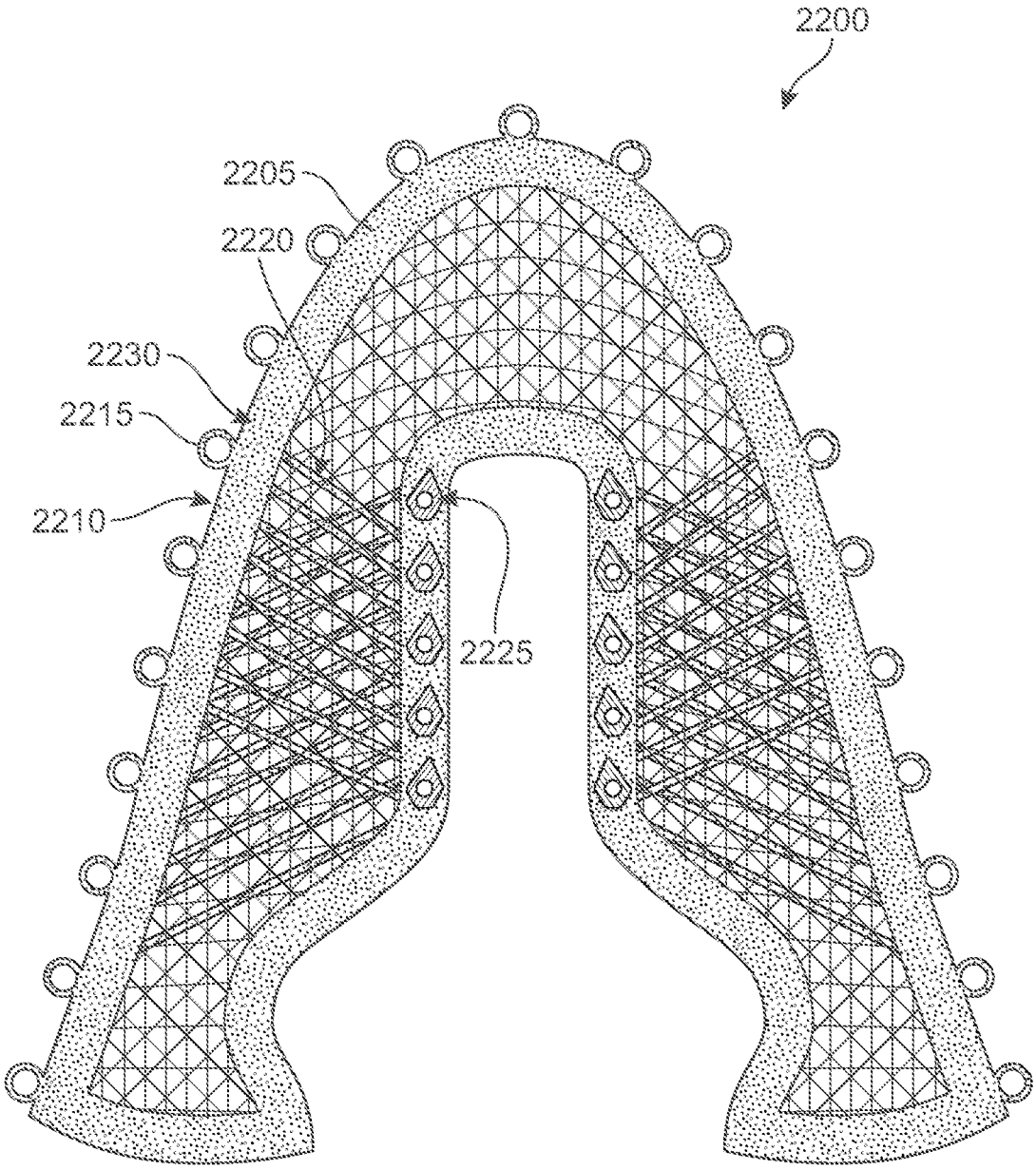
FIG. 22 is a schematic top-down view illustration of an embodiment of an upper with a ribbon structure and embroidered loops.

FIG. 22 is a schematic top-down view illustration of an embodiment of an upper with a ribbon structure and embroidered loops. As shown in FIG. 22, an upper 2200 may include an embroidered panel 2205. Embroidered panel 2205 may include an embroidered peripheral portion 2230, which may have a peripheral edge 2110. Further, upper 2200 may include a plurality of embroidered loops 2215 extending from peripheral portion 2230, the plurality of embroidered loops 2215 being configured to receive a lasting string to draw the edges (2210) of peripheral portion 2230 of upper 2200 together for lasting.

As also shown in FIG. 22, upper 2200 may also include a ribbon structure 2220 formed of a plurality of ribbon sections disposed in at least a portion of upper 2200. As further shown in FIG. 22, in some embodiments, two or more ribbon sections of ribbon structure 2220 may overlap one another. In such embodiments, the ribbon sections that overlap one another may be fixedly attached to one another by embroidery stitching. Ribbon structure 2220 may have any of the various configurations and features discussed above with respect to other embodiments. For example, as shown in FIG. 22, ribbon structure 2220 may extend between one or more eyelets 2225 and peripheral portion 2230 of upper 2200.

Figure 23:
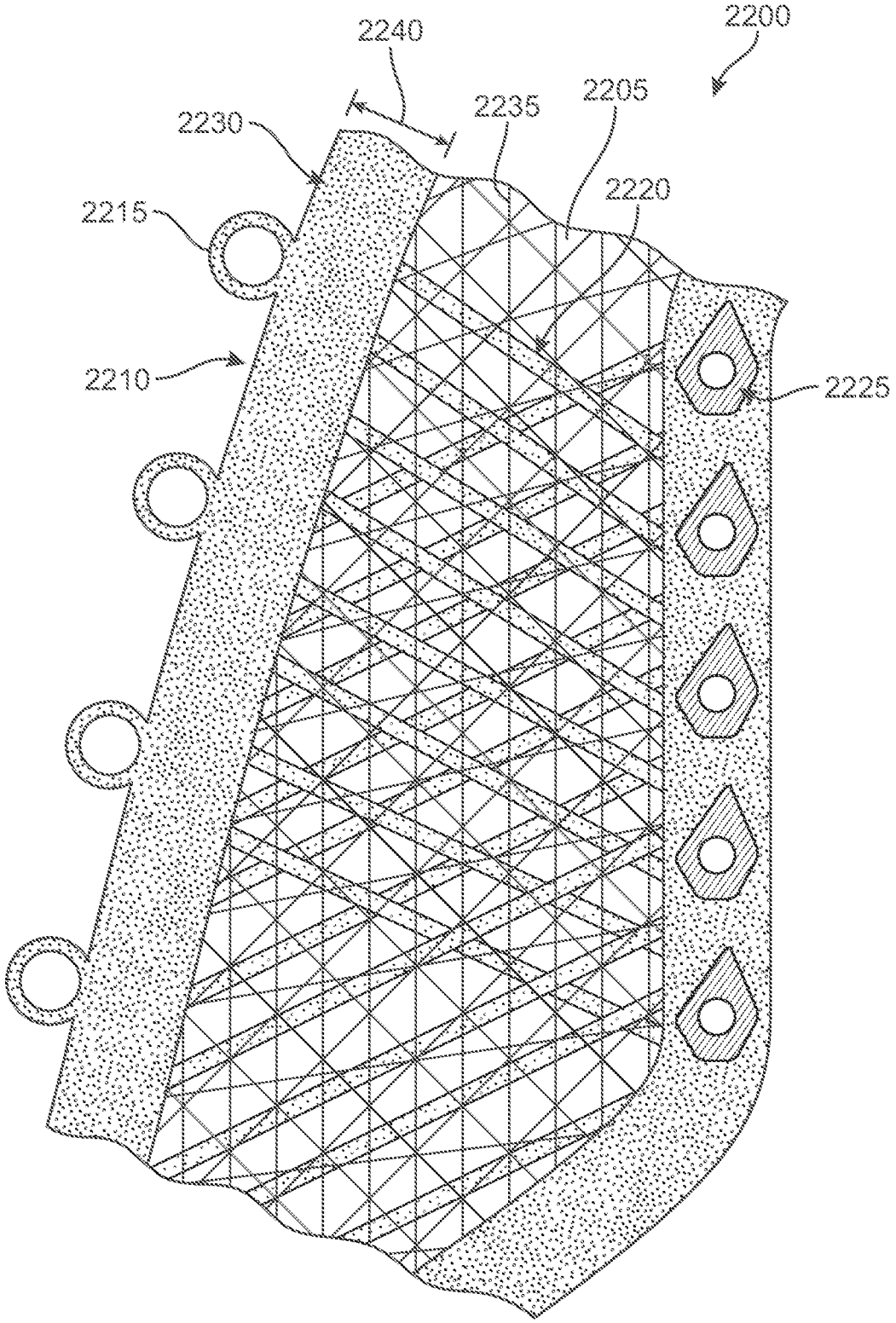
FIG. 23 is an enlarged schematic top-down view illustration of the upper shown in FIG. 22.

FIG. 23 is an enlarged schematic top-down view illustration of the upper shown in FIG. 22. As shown in FIG. 23, in some embodiments, ribbon structure 2220 may extend into peripheral portion 2230. For example, as shown in FIG. 23, peripheral portion 2230 may include embroidery that secures the ends of ribbon sections forming ribbon structure 2220, and also provides reinforcement to peripheral portion 2230 of upper 2200. This reinforcement may provide a sturdy platform for anchoring upper 2200 to a strobel and/or to a sole structure.

When peripheral portion 2230 of upper 2200 is fixedly attached to a strobel or sole structure, embroidered loops 2215 may remain unattached to the strobel and/or sole structure in order to permit removal of a lasting string used to draw the edges 2210 of peripheral portion 2230 of upper 2200 together for attachment to the strobel or sole structure. That is, only the band of peripheral portion 2230 illustrated by dimension 2240 (or a portion thereof) may be fixedly attached to the strobel or sole structure. Accordingly, embroidered loops 2215 may be left unattached, enabling the lasting string to be removed.

As also shown in FIG. 23, in some embodiments, upper 2200 may include embroidery 2235 that fixedly attaches overlapping ribbon sections to one another.

Figure 24:
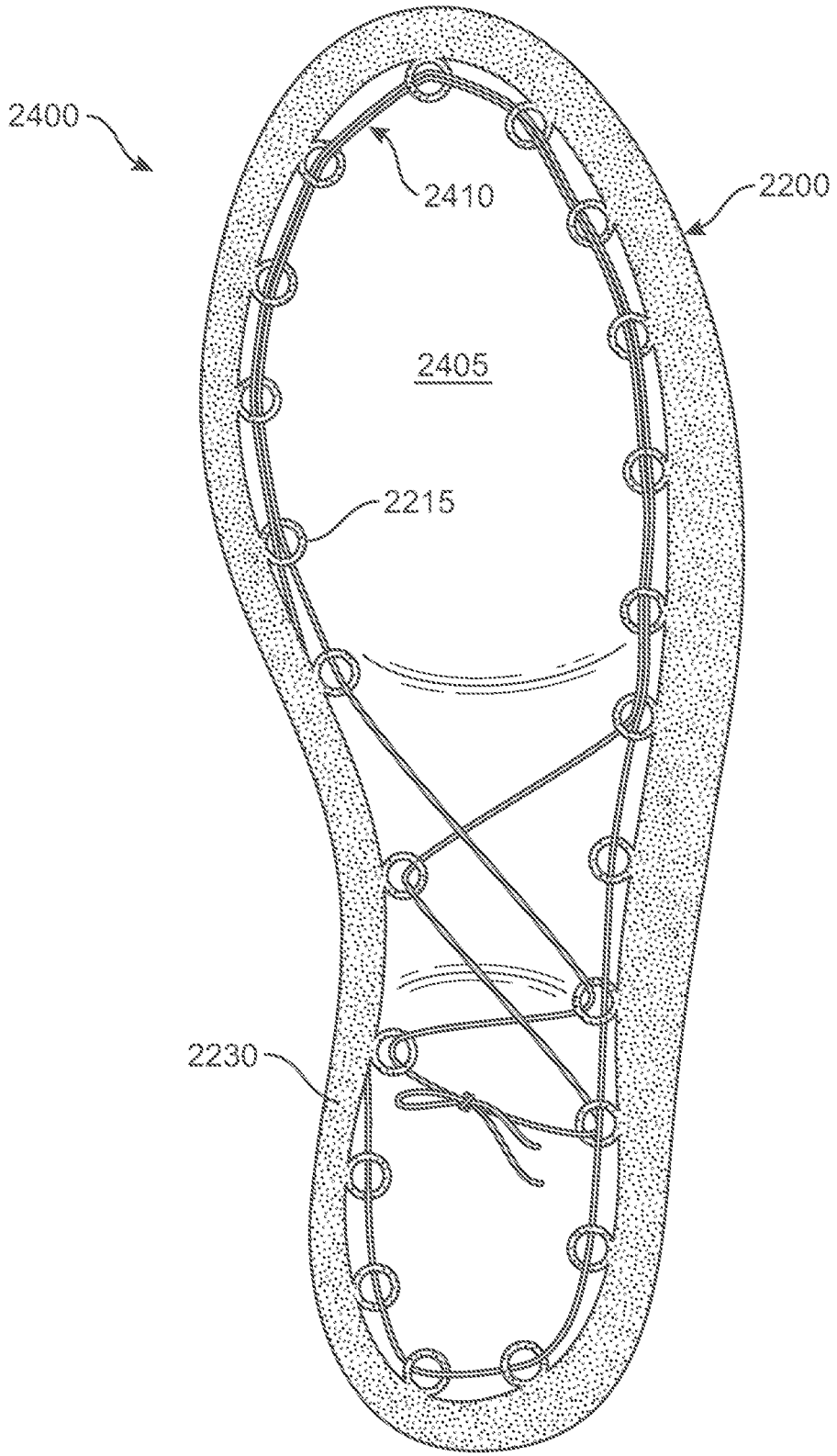
FIG. 24 is a schematic bottom view of the upper shown in FIG. 22 mounted on a last.

FIG. 24 is a schematic bottom view of the upper shown in FIG. 22 mounted on a last. FIG. 24 shows an article of footwear 2400 formed using upper 2200. As shown in FIG. 24, manufacturing footwear 2400 may be include forming a piece of upper material (2200) including an embroidered peripheral portion 2230 and a plurality of embroidered loops 2215 extending from peripheral portion 2230, the piece of upper material having a shape configured to form an upper for the article of footwear.

In order to assemble the article of footwear, the method may include mounting the piece of upper material onto a last 2405 and drawing the peripheral edges of the piece of upper material toward one another at the bottom of the last by performing a string lasting process. The string lasting process may include threading a lasting string 2410 through the plurality of embroidered loops 2215, and pulling lasting string 2410 to produce tension in lasting string 2410 and tighten the piece of upper material around the last.

The method may also include and fixedly attaching peripheral portion 2230 of the piece of upper material to a strobel or sole structure. When fixedly attaching peripheral portion 2230 to the strobel or sole structure, embroidered loops 2215 may remain unattached to the strobel or sole structure. Accordingly, once peripheral portion 2230 is fixedly attached to the strobel or sole structure, the method may include removing lasting string 2410. If a strobel is used, after the lasting string is removed, the upper may be attached to a sole structure.

Alternatively, the upper may be attached to a sole structure without using a strobel. In such assembly method, embroidered loops 2215 may also remain unattached to the sole structure after attaching the sole structure to the upper. Accordingly, lasting string 2410 may be removed after the sole structure is attached. For example, since no strobel is included, access to the lasting string may be provided from inside the assembled shoe, such that the lasting string may be removed via the ankle opening of the shoe. Accordingly, any of the embodiments disclosed herein may be assembled in a manner that permits removal of the lasting string during or after assembly of the article of footwear.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

The invention claimed is:

1. A method of manufacturing an article of footwear, comprising:

forming a piece of upper material including an embroidered peripheral portion and a plurality of embroidered loops extending from the embroidered peripheral portion, the piece of upper material having a shape configured to form an upper for the article of footwear;

mounting the piece of upper material onto a last;

drawing peripheral edges of the piece of upper material toward one another at the bottom of the last by performing a string lasting process including:

threading a lasting string through the plurality of embroidered loops; and pulling the lasting string to produce tension in the lasting string and tighten the piece of upper material around the last; and fixedly attaching the embroidered peripheral portion of the piece of upper material to a sole structure.

2. The method of claim 1, wherein the piece of upper material comprises a ribbon structure formed by a plurality of ribbon sections.

3. The method of claim 2, wherein a portion of the ribbon structure extends into the embroidered peripheral portion; and forming the piece of upper material includes embroidering ends of ribbon sections of the plurality of ribbon sections that extend into the embroidered peripheral portion.

4. The method of claim 2, further comprising embroidering overlapping ribbon sections of the plurality of ribbon sections of the ribbon structure to one another.

5. The method of claim 1, wherein fixedly attaching the piece of upper material to the sole structure includes selectively securing peripheral portions of the sole structure and the piece of upper material such that a portion of each of the plurality of embroidered loops remains unattached to the sole structure.

6. The method of claim 1, further including removing the lasting string after fixedly attaching the piece of upper material to the sole structure.

* * * * *